US012268277B2

(12) United States Patent
Hopkins

(10) Patent No.: US 12,268,277 B2
(45) Date of Patent: Apr. 8, 2025

(54) FOOT SUPPORT SYSTEMS, SOLE STRUCTURES, AND ARTICLES OF FOOTWEAR INCLUDING INTERCONNECTED BLADDER CHAMBERS FOR INDUCING TILT

(71) Applicant: NIKE, Inc., Beaverton, OR (US)

(72) Inventor: Timothy P. Hopkins, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 347 days.

(21) Appl. No.: 17/325,607

(22) Filed: May 20, 2021

(65) Prior Publication Data

US 2021/0361030 A1 Nov. 25, 2021

Related U.S. Application Data

(60) Provisional application No. 63/029,054, filed on May 22, 2020.

(51) Int. Cl.
*A43B 13/20* (2006.01)
*A43B 13/18* (2006.01)

(52) U.S. Cl.
CPC ..... *A43B 13/203* (2013.01); *A43B 13/188* (2013.01)

(58) Field of Classification Search
CPC ..... A43B 13/206; A43B 17/035; A43B 21/285; A43B 13/203; A43B 13/20; A43B 13/188
See application file for complete search history.

(56) References Cited

U.S. PATENT DOCUMENTS 4,219,945 A * 9/1980 Rudy ..... A43B 13/40 36/44
4,446,634 A * 5/1984 Johnson ..... A43B 13/203 36/43

(Continued)

FOREIGN PATENT DOCUMENTS

DE 202009007220 U1 9/2010
DE 102015225209 A1 6/2017

(Continued)

OTHER PUBLICATIONS

"I tried to wear a Donkey's leather shoes", Gigazine, gigazine.net Mar. 13, 2017, https://web.archive.org/web/20170313021351/https://gigazine.net/news/20170312-donki-slide-sole-change/Discloses a shoe sole having a removable heel portion which slides along rails (translated).

(Continued)

*Primary Examiner* — Katharine G Kane
(74) *Attorney, Agent, or Firm* — Banner & Witcoff, Ltd.

(57) ABSTRACT

Sole structures, foot support systems, articles of footwear, and/or other devices include movable fluid that induces foot tilt, e.g., forefoot tilt. These components may include first and second side foot support bladder chambers; a fluid flow control system that moves fluid through each of first and second fluid flow paths; a first fluid line connecting the fluid flow control system with the first side foot support bladder chamber; and a second fluid line connecting the fluid flow control system with the second side foot support bladder chamber. In the first fluid flow path, fluid moves from the first side foot support bladder chamber to the second side foot support bladder chamber through the fluid flow control system. In the second fluid flow path, fluid moves from the second side foot support bladder chamber to the first side (Continued)

foot support bladder chamber through the fluid flow control system.

20 Claims, 13 Drawing Sheets

(56) References Cited

U.S. PATENT DOCUMENTS 5,025,575 A * 6/1991 Lakic ..... A43B 17/08 36/44
5,113,599 A * 5/1992 Cohen ..... A43B 23/029 36/114
5,179,792 A * 1/1993 Brantingham ..... A43B 13/203 36/71
5,222,312 A * 6/1993 Doyle ..... A43B 13/203 36/28
5,353,522 A 10/1994 Wagner
5,392,537 A 2/1995 Goldberg
5,406,719 A * 4/1995 Potter ..... A43B 13/203 36/35 B
5,794,361 A * 8/1998 Sadler ..... A43B 13/203 36/35 B
5,862,689 A 1/1999 Wen
5,881,478 A 3/1999 McMahon et al.
5,921,009 A 7/1999 Hice
5,987,779 A * 11/1999 Litchfield ..... A43B 3/34 36/29
6,115,943 A 9/2000 Gyr
D443,974 S 6/2001 Schelling
6,305,102 B1 * 10/2001 Doyle ..... A43B 13/206 36/71
6,430,843 B1 * 8/2002 Potter ..... A43B 13/203 36/43
6,550,160 B2 4/2003 Miller, II
6,553,691 B2 * 4/2003 Huang ..... A43B 17/08 36/35 B
6,829,848 B2 12/2004 Gallegos
7,254,905 B2 8/2007 Dennison
7,377,055 B2 5/2008 Bramani
7,448,150 B1 * 11/2008 Davis ..... A43B 13/203 36/35 B
7,478,488 B1 * 1/2009 Davis ..... A43B 23/029 36/3 A
7,578,077 B2 8/2009 Marc
7,596,888 B2 10/2009 Meschan et al.
7,654,014 B1 2/2010 Moore et al.
8,141,276 B2 3/2012 Ellis
8,234,800 B2 8/2012 Buder et al.
9,226,545 B2 1/2016 Peyton et al.
9,445,643 B2 9/2016 Amos et al.
9,820,531 B2 11/2017 Walker et al.
10,123,586 B2 11/2018 Meschter
10,226,102 B2 3/2019 Santos et al.
2001/0045026 A1 * 11/2001 Huang ..... A43B 17/035 36/35 B
2001/0054242 A1 * 12/2001 Miller, II ..... A43B 13/184 36/144
2002/0035794 A1 * 3/2002 Doyle ..... A43B 13/206 36/28
2002/0053146 A1 * 5/2002 Swigart ..... A43B 13/206 36/35 B
2005/0246923 A1 11/2005 Bergamin
2006/0248750 A1 * 11/2006 Rosenberg ..... A43B 1/0054 36/29
2008/0022562 A1 1/2008 Manis
2008/0222920 A1 9/2008 Rovida
2009/0151203 A1 * 6/2009 Boyer ..... A43B 7/082 36/3 R
2010/0199518 A1 * 8/2010 Buttigieg ..... A43B 13/206 36/29
2010/0281716 A1 11/2010 Luthi et al.
2011/0131839 A1 * 6/2011 Ballin ..... A43B 3/34 36/141
2012/0073161 A1 * 3/2012 Doyle ..... A43B 13/203 36/29
2012/0255198 A1 * 10/2012 Langvin ..... F16K 15/20 36/29
2013/0278436 A1 * 10/2013 Ellis ..... G16H 20/30 36/43
2013/0326912 A1 * 12/2013 Lindsay ..... A43B 7/1425 36/103
2014/0041256 A1 2/2014 Espinola
2015/0305436 A1 * 10/2015 Doyle ..... A43B 17/035 36/43
2016/0345663 A1 * 12/2016 Walker ..... A43B 5/10
2017/0071287 A1 * 3/2017 Kim ..... A43C 15/09
2017/0150785 A1 * 6/2017 Walker ..... A43B 13/20
2017/0295885 A1 * 10/2017 Stern ..... F16F 15/04
2018/0008005 A1 1/2018 Compton et al.
2018/0020771 A1 * 1/2018 Lo ..... A43B 13/203 36/29
2020/0046070 A1 2/2020 Henrichot et al.

FOREIGN PATENT DOCUMENTS

EP 0815756 B1 3/2002
EP 1958527 B1 1/2016
WO 2014193078 A1 12/2014

OTHER PUBLICATIONS

"Nike CONVERT 1.0", Climate Colab, climatecolab.org, Jun. 11, 2016, https://web.archive.org/web/20160611110604/https://www.climatecolab.org/contests/2016/materials-matter/c/proposal/1331584/ Discloses an athletic shoe with replaceable sole elements.
Aug. 20, 2021—(WO) ISR & WO—App. No. PCT/US21/033630.

* cited by examiner

FOOT SUPPORT SYSTEMS, SOLE STRUCTURES, AND ARTICLES OF FOOTWEAR INCLUDING INTERCONNECTED BLADDER CHAMBERS FOR INDUCING TILT

RELATED APPLICATION DATA

This application claims priority benefits to and is a U.S. Non-Provisional patent application based on U.S. Provisional Patent Appln. No. 63/029,054 filed May 22, 2020. U.S. Provisional Patent Appln. No. 63/029,054 is entirely incorporated herein by reference.

FIELD OF THE INVENTION

The present invention relates to foot support systems in the field of footwear or other foot-receiving devices. At least some aspects of the present invention pertain to sole structures, foot support systems, articles of footwear, and/or other foot-receiving devices that include interconnected fluid-filled bladder chambers where fluid is movable between the chambers to induce foot tilt.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces). The upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, track spikes, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

SUMMARY

This Summary is provided to introduce some general concepts relating to this technology in a simplified form that are further described below in the Detailed Description. This Summary is not intended to identify key features or essential features of the invention.

Aspects of this technology relate to sole structures, foot support systems, articles of footwear, and/or other foot-receiving devices, e.g., of the types described and/or claimed below and/or of the types illustrated in the appended drawings. Such sole structures, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

More specific aspects of this technology relate to sole structures, foot support systems, articles of footwear, and/or other foot-receiving devices that include fluid-filled bladder chambers placed or configured to be placed in fluid communication with one another and in which fluid is movable between the chambers to induce foot tilt (at least under certain conditions and/or configurations of a fluid flow control system and/or the foot support system).

While aspects of this technology are described in terms of foot support systems and articles of footwear including them, additional aspects of this technology relate to methods of making such foot support systems and/or articles of footwear and/or methods of using such foot support systems and/or articles of footwear.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
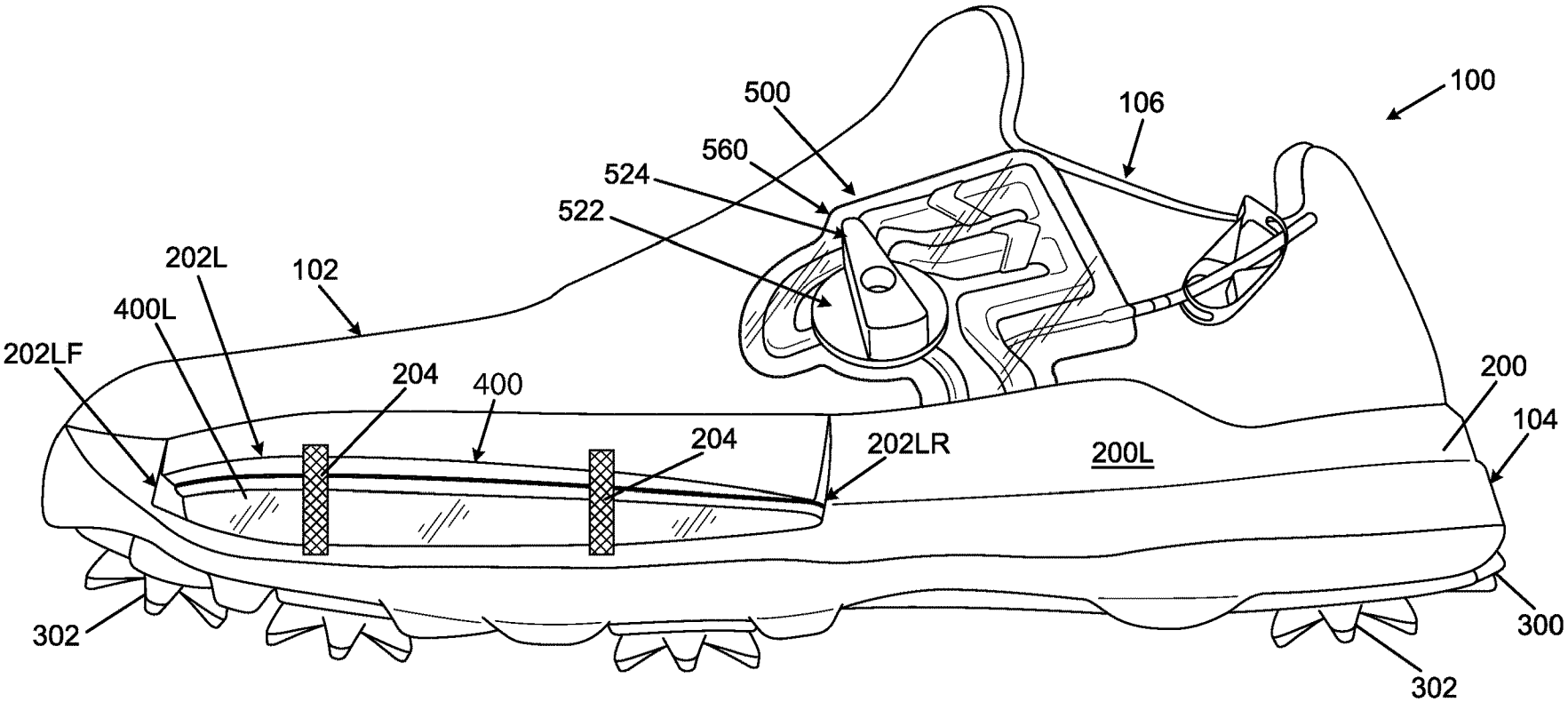
FIGS. 1A-1C provide various views of an article of footwear having a foot support system in accordance with some examples of this technology.

In the following description of various examples of foot support systems and components according to the present technology, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

Various structures and parameters of foot support systems, articles of footwear, and sole structures thereof are described in this specification based on a sole "length" or article of footwear "length" parameter L. See FIG. 1B. These lengths L can be found with the article of footwear and/or sole structure oriented on a horizontal support surface S on its ground-facing surface in an unloaded condition (e.g., with no weight applied to it other than weight of other components of the article of footwear and/or sole structure). Once so oriented, parallel vertical planes VP perpendicular to the horizontal support surface S are oriented to contact the rearmost heel (RH) location(s) and forwardmost toe (FT) location(s) of the relevant part (e.g., the article of footwear and/or sole structure). The parallel vertical planes VP should be oriented facing one another (e.g., extending into and out of the page of FIG. 1B) and as far away from one another as possible while still in contact with the rearmost heel RH and forwardmost toe FT locations. The direct distance between these vertical parallel planes VPs corresponds to the length (e.g., a longitudinal length) L of the article of footwear and/or sole structure. The locations of various footwear components or features are described in this specification based on their respective locations along the length L as measured forward from the rear heel vertical plane VP. The rearmost heel RH location(s) is (are) located at position 0L and the forwardmost toe FT location(s) is (are) located at position 1L along the length L. Intermediate locations along the length L are referred to by fractional locations (e.g., 0.5L, 0.75L) along the length L measured forward from the rear heel vertical plane VP. The term "parallel planes" as used herein are planes oriented parallel to the vertical planes VP. These parallel planes may intersect the longitudinal length L or longitudinal direction somewhere between P=0L and P=1.0L to identify the locations of various features. Note FIG. 1B, which includes parallel plane location designators at 0.25L, 0.5L, and 0.75L.

Fluid foot support systems are described herein using the terms "fluid-filled bladder" and "fluid-filled bladder chamber," and the fluid foot support systems are described as containing at least two side "fluid-filled bladders" and/or two side "fluid-filled bladder chambers." Those skilled in the art given benefit of this disclosure should understand that when the term "fluid-filled bladders" is used, that specific fluid foot support system may include: (a) at least two individual parts, e.g., with a separate part forming each of the individual side fluid-filled bladders, or (b) one component part having individual fluid-filled bladder chambers forming the two side fluid-filled bladders. Those skilled in the art given benefit of this disclosure also should understand that when the term "fluid-filled bladder chambers" is used, that specific fluid foot support system may include the two side fluid-filled bladder chambers formed from one part or from two or more individual parts. Additionally or alternatively, if desired, one or both of the side fluid-filled bladders or side fluid-filled bladder chambers described below could include two or more individual compartments or chambers (in fluid communication or not in fluid communication) that form that specific side fluid-filled bladder and/or chamber. Thus, the fluid foot support systems and/or the fluid-filled bladders and/or the fluid-filled bladder chambers described herein may be formed from one or more total component parts.

The term "inlet/outlet" as used herein is intended to mean "an inlet and/or an outlet." The terms "fluid line" and "fluid path" as used herein include fluid transfer structures made from one or more component parts (e.g., plastic tubing, extruded parts, molded parts, etc.).

The "fluid" used in the various example fluid-filled bladders and fluid-filled bladder chambers described below may constitute a gas or a combination of gases. Such gas or gases may be any desired type of gas conventionally used in fluid-filled bladders in commercial footwear products, e.g., like those available from NIKE, Inc. of Beaverton, Oregon. Examples of usable gases include: air, nitrogen, etc.

I. General Description of Aspects of this Technology

As noted above, aspects of this technology relate to sole structures, foot support systems, articles of footwear, and/or other foot-receiving devices, e.g., of the types described and/or claimed below and/or of the types illustrated in the appended drawings. Such sole structures, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Some specific aspects or examples of this technology relate to foot support systems, sole structures, articles of footwear, and/or other foot-receiving devices that include:

- a first side foot support bladder chamber;
- a second side foot support bladder chamber;
- a fluid flow control system including a first port and a second port, wherein the fluid flow control system moves fluid through each of a first fluid flow path and a second fluid flow path;
- a first fluid line connecting the first port with the first side foot support bladder chamber; and
- a second fluid line connecting the second port with the second side foot support bladder chamber, wherein, in the first fluid flow path, fluid moves: (a) from the first side foot support bladder chamber, (b) through the first fluid line, (c) through the first port, (d) through the fluid flow control system to the second port, (e) through the second port, (f) through the second fluid line, and (g) into the second side foot support bladder chamber, wherein, in the second fluid flow path, fluid moves: (a) from the second side foot support bladder chamber, (b) through the second fluid line, (c) through the second port, (d) through the fluid flow control system to the first port, (e) through the first port, (f) through the first fluid line, and (g) into the first side foot support bladder chamber.

Additionally or alternatively, some specific aspects or examples of this technology relate to foot support systems, sole structures, articles of footwear, and/or other foot-receiving devices that include:

a first side foot support bladder chamber;

a second side foot support bladder chamber separated from the first side foot support bladder chamber;

a fluid distributor having a first inlet/outlet, a second inlet/outlet, and a third inlet/outlet;

a first fluid line connecting the first side foot support bladder chamber and the first inlet/outlet;

a second fluid line connecting the second side foot support bladder chamber and the second inlet/outlet;

a third fluid line connecting the third inlet/outlet to at least one of the first fluid line or the first side foot support bladder chamber; and a switch changing fluid flow directions through the foot support system into each of at least a first fluid flow path and a second fluid flow path, wherein:

(A) the first fluid flow path includes a first path extending: (a) from the first side foot support bladder chamber, (b) through the first fluid line, (c) through the first inlet/outlet, (d) through the fluid distributor to the second inlet/outlet, (e) through the second inlet/outlet, (f) through the second fluid line, and (g) into the second side foot support bladder chamber, (B) the second fluid flow path includes a second path extending: (a) from the second side foot support bladder chamber, (b) through the second fluid line, (c) through the second inlet/outlet, (d) through the fluid distributor to the third inlet/outlet, (e) through the third inlet/outlet, and (f) into the first side foot support bladder chamber through the first fluid line or another fluid path.

Also additionally or alternatively, some specific aspects or examples of this technology relate to foot support systems, sole structures, articles of footwear, and/or other foot-receiving devices that include:

a first side foot support bladder chamber including a first inner side (e.g., an interior edge of the first bladder chamber), a first outer side (e.g., an exterior edge of the first bladder chamber), a first top interior surface, and a first bottom interior surface;

a second side foot support bladder chamber including a second inner side (e.g., an interior edge of the second bladder chamber), a second outer side (e.g., an exterior edge of the second bladder chamber), a second top interior surface, and a second bottom interior surface, wherein the second inner side faces the first inner side; and one or more fluid channels placing the first side foot support bladder chamber in fluid communication with the second side foot support bladder chamber to support movement of fluid between the first side foot support bladder chamber and the second side foot support bladder chamber, wherein the foot support system is configured to be changed between a first configuration and a second configuration by moving fluid between the first side foot support bladder chamber and the second side foot support bladder chamber through the one or more fluid channels, wherein:

(a) in the first configuration: (i) at a first location closer to the first outer side than to the first inner side, the first top interior surface and the first bottom interior surface are spaced from one another by a first height and (ii) at a second location closer to the second outer side than to the second inner side, the second top interior surface and the second bottom interior surface are spaced from one another by a second height, (b) in the second configuration: (i) at the first location, the first top interior surface and the first bottom interior surface are spaced from one another by a third height and (ii) at the second location, the second top interior surface and the second bottom interior surface are spaced from one another by a fourth height, (c) the first height is greater than the third height, and the fourth height is greater than the second height.

Given the general description of features, examples, aspects, structures, processes, and arrangements according to examples of the technology provided above, a more detailed description of specific example foot support structures, sole structures, articles of footwear, and methods in accordance with this technology follows.

Figure 1B:
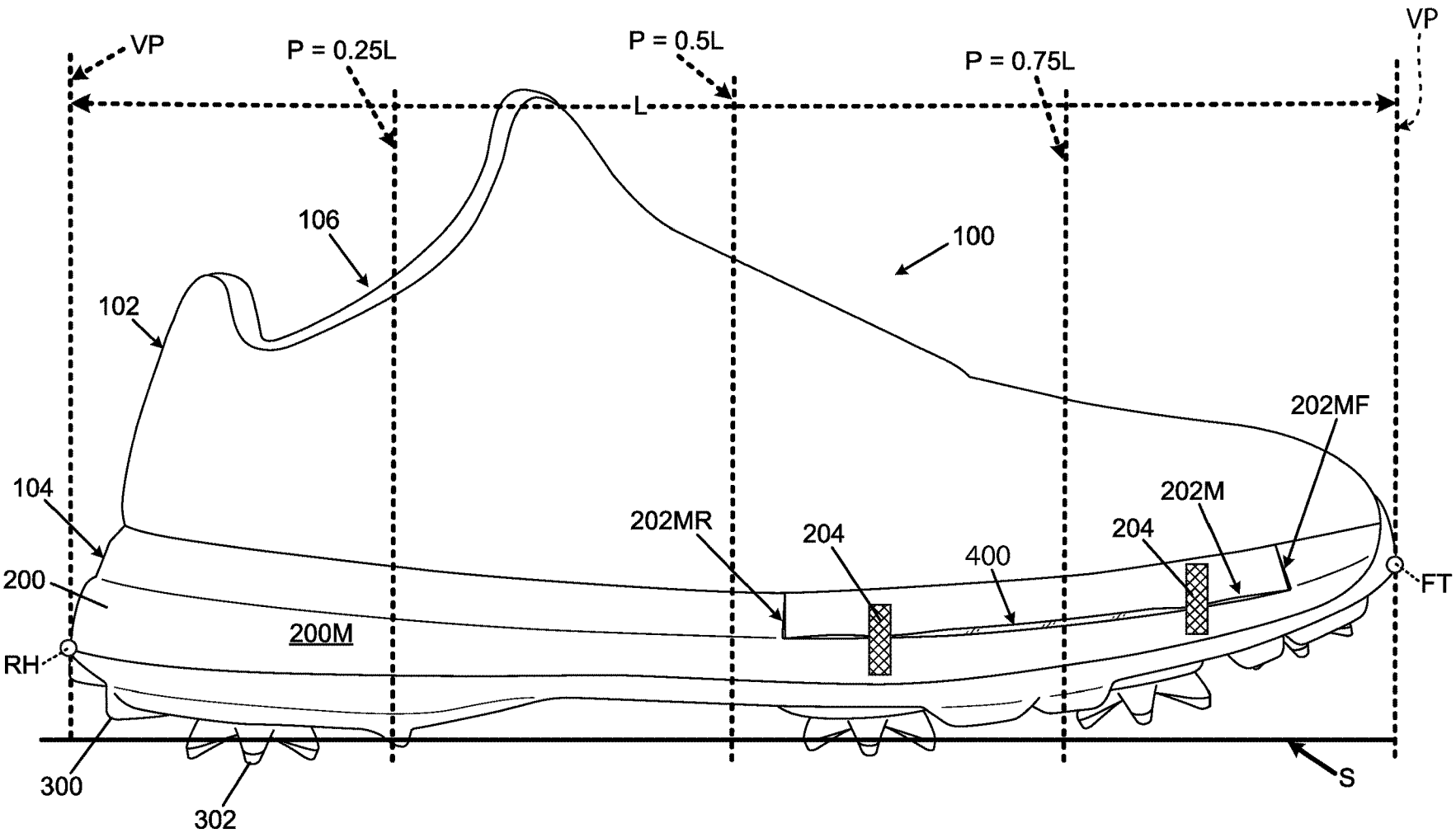
Figure 1C:
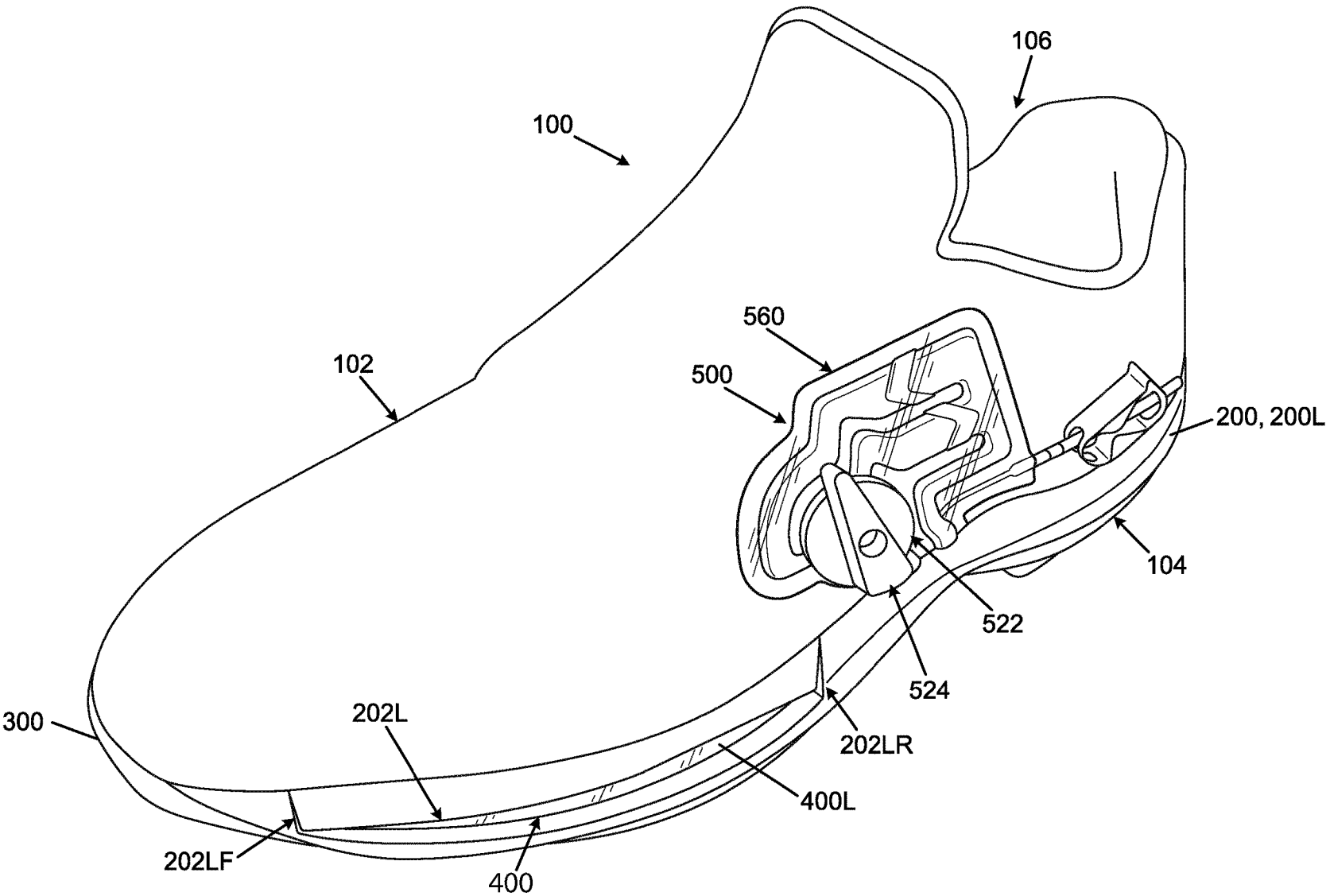

II. Detailed Description of Example Articles of Footwear, Foot Support Systems, and Other Components/Features According to this Technology FIGS. 1A-1C provide a lateral side view, a medial side view, and a top, front, lateral perspective view, respectively, of an article of footwear 100 in accordance with some aspects of this technology. While the specific example shown in FIGS. 1A-1C includes a sole structure 104 for a golf shoe, aspects of this technology may be used with articles of footwear 100 and/or sole structures 104 for other types of activities as well (e.g., track/sprinting shoes, basketball shoes, etc.).

The article of footwear 100 of FIGS. 1A-1C includes an upper 102 and a sole structure 104 engaged with the upper 102. The upper 102 and sole structure 104 may be engaged together in any desired manner, including in manners conventionally known and used in the footwear arts (such as by one or more of adhesives or cements, stitching or sewing, mechanical connectors, etc.), provided at least some of the disclosed relative motion activities in accordance with aspects of this technology can be carried out.

The upper 102 (which may be formed from one or more parts), potentially together with the sole structure 104, defines a foot-receiving interior chamber 106 for containing a wearer's foot. The bottom of the upper 102 may include a strobel or other component engaged with or integrally formed with another portion of the upper 102. The upper 102 may include other components as well. For example, the upper 102 may include a tongue member located across the foot instep area and positioned to moderate the feel of the footwear's closure system on the wearer's foot; a closure system (e.g., including one or more of a lace type closure system, a zippered closure system, a buckle type closure system, elastic stretch elements, one or more straps, etc.); a heel counter; a toe cap; securing straps; etc. Additionally or alternatively, the upper 102 may include a "sock-like" upper component, e.g., made from fabric and configured to closely fit the wearer's foot like a conventional sock.

The upper 102 may be made from any desired material(s) and/or in any desired constructions and/or manners without departing from this technology. As some more specific examples, all or at least a portion of the upper 102 (and optionally a majority, substantially all, or even all of the upper 102) may be formed as a woven textile component, a knitted textile component, another textile component, a natural leather component, a synthetic leather component, a polymeric component (e.g., a TPU, etc.), etc. The components for upper 102 may have structures and/or constructions like those used in footwear products commercially available from NIKE, Inc. of Beaverton, OR and/or other manufacturers, including conventional structures and constructions as are known and used in the art.

Additionally or alternatively, if desired, the upper 102 construction may include uppers having foot securing and engaging structures, e.g., of the types described in U.S. Patent Appln. Publn. No. 2013/0104423, which publication is entirely incorporated herein by reference. As some additional examples, if desired, uppers 102 and articles of footwear 100 in accordance with this technology may include foot securing and engaging structures of the types used in footwear products commercially available from NIKE, Inc. of Beaverton, Oregon. These types of structures may at least partially wrap around and securely hold the wearer's foot, particularly in the midfoot and/or heel areas.

As yet another alternative or additional feature, if desired, uppers 102 and articles of footwear 100 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, uppers of the types described in U.S. Pat. Nos. 7,347,011 and/or 8,429,835 may be used without departing from this technology (each of U.S. Pat. Nos. 7,347,011 and 8,429,835 is entirely incorporated herein by reference).

More specific features, constructions, and operation of the example articles of footwear 100 and sole structures 104 thereof now will be described in conjunction with FIGS. 1A to 7. As shown in FIGS. 1A-1C, this example sole structure 104 includes a midsole component 200, an outsole component 300 engaged with the midsole component 200, and a fluid foot support system 400 having at least a portion engaged with and/or at least partially contained within the midsole component 200 (and, in this illustrated example, having a portion engaged with the footwear upper 102). The midsole component 200 may be made from one or more component parts. As some more specific examples, the midsole component 200 may include a polymeric foam material, such as ethylvinyl acetate (EVA), polyurethane foam, and/or thermoplastic materials. Additionally or alternatively, if desired, the midsole component 200 may include: (a) one or more fluid-filled bladders (e.g., in the heel support area, optionally in addition to the fluid-filled bladders that constitute part of the fluid foot support system 400 to be described in more detail below) and/or (b) one or more mechanical shock absorbing components as impact force attenuating elements (e.g., to attenuate ground-reaction forces when a wearer lands a step or jump). When present, any fluid-filled bladder(s) (including those of the fluid foot support system 400) and/or mechanical shock absorbing component(s) may be engaged with another part of the midsole component 200 and/or at least partially embedded in the midsole component 200 (e.g., embedded in foam material) and/or they may be separate parts from midsole component 200. The midsole component 200 may have any desired number of parts and/or any desired structures or constructions, including parts, structures, and/or constructions as are known and used in the footwear art, provided the desired functions of the present technology can be supported. The fluid foot support system 400 described herein may be considered part of the midsole component 200 or it may be considered a separate part from midsole component 200.

As a more specific example, the midsole component 200 may include a ground-facing member having an upper-facing surface (e.g., top surface) and a ground-facing surface opposite the upper-facing surface (e.g., bottom surface). Some or all of the fluid foot support system 400 (e.g., its medial side and lateral side bladder chambers) may be at least partially covered and/or supported by this ground-facing member. As some even more specific examples, the midsole component 200 may constitute, at least in part, a polymeric foam midsole forming at least a portion of the upper-facing surface, and the fluid foot support system 400 may be at least partially contained within a cavity defined in the upper-facing surface of the polymeric foam midsole and/or embedded within a cavity defined in the polymeric foam midsole.

The outsole component 300 of this example is engaged with the ground-facing surface of the midsole component 200. While a single outsole component 300 is shown in these figures, the outsole component 300 may be made from one or more parts. The outsole component(s) 300 may be engaged with the midsole component 200 in any desired manner without departing from this technology, including by any one or more of adhesives, mechanical connectors, fusing techniques, etc. Additionally or alternatively, if desired, the outsole component(s) 300 may include sidewalls that extend upward to engage some or all of lateral sidewall 200L and/or medial sidewall 200M of midsole component 200. Also, because this example article of footwear 100 and sole structure 104 comprise a golf shoe, the bottom of outsole component 300 includes cleats 302 (or other traction-enhancing features, e.g., suitable for use while playing golf). Other types of golf cleats, spikes, other cleats, and/or other traction-enhancing features may be provided without departing from this technology. The outsole component(s) 300 may be made from any desired materials, including materials as are conventionally known and used in the footwear arts including the golf shoe art (e.g., rubbers, TPUs, etc.). When multiple outsole components 300 are present, the various outsole component parts need not be made from the same materials.

Aspects of the fluid foot support system 400 now will be described. The term "fluid foot support system" as used herein relates to two (or more) interconnected fluid-filled bladder chambers, e.g., bladders 400L and 400M in fluid communication with one another. The bladders 400L, 400M may be in fluid communication via a fluid flow control system 500 that selectively moves fluid between the bladders 400L, 400M. As will be explained in detail below, such movement of fluid causes one bladder to increase in height while the other bladder decreases in height to change an angular orientation of at least a portion of the overall foot support system. In this example fluid foot support system 400, fluid moves between a lateral side fluid-filled bladder 400L (e.g., located in a lateral side forefoot area of the sole structure 104) and a medial side fluid-filled bladder 400M (e.g., located in a medial side forefoot area of the sole structure 104), in either direction, to change the heights of bladder 400L and bladder 400M. This movement of fluid may cause an area of the sole structure 104 (e.g., at least the forefoot area) to tilt inward or outward. Some or all of the structures interconnecting lateral side fluid-filled bladder 400L and medial side fluid-filled bladder 400M constitute at least some of the "fluid flow control system" 500 as that term is used herein.

In the specifically illustrated example of FIGS. 4A-5B, the fluid foot support system 400 includes: (a) a first side foot support bladder chamber (e.g., bladder 400M); (b) a second side foot support bladder chamber (e.g., bladder 400L) optionally separated and/or spaced apart from the first side foot support bladder 400M; and (c) a fluid flow control system 500 including a first port 502A and a second port 502B. The fluid flow control system 500 moves fluid through each of a first fluid flow path and a second fluid flow path to be described in more detail below. In this example, fluid flow control system 500 is shown enclosed within a broken line boundary 560. This broken line boundary 560 may represent a physical component part or parts (e.g., a substrate, housing, or base) that houses and/or supports the components of the fluid flow control system 500, or it may represent a virtual or conceptual boundary. If needed, the ports 502A, 502B may include a nipple or other gas line connector structural components to which a tube or fluid line may attach. A first fluid line 402M connects the first port 502A with the first side foot support bladder 400M. Similarly, a second fluid line 402L connects the second port 502B with the second side foot support bladder 400L.

Figure 5A:
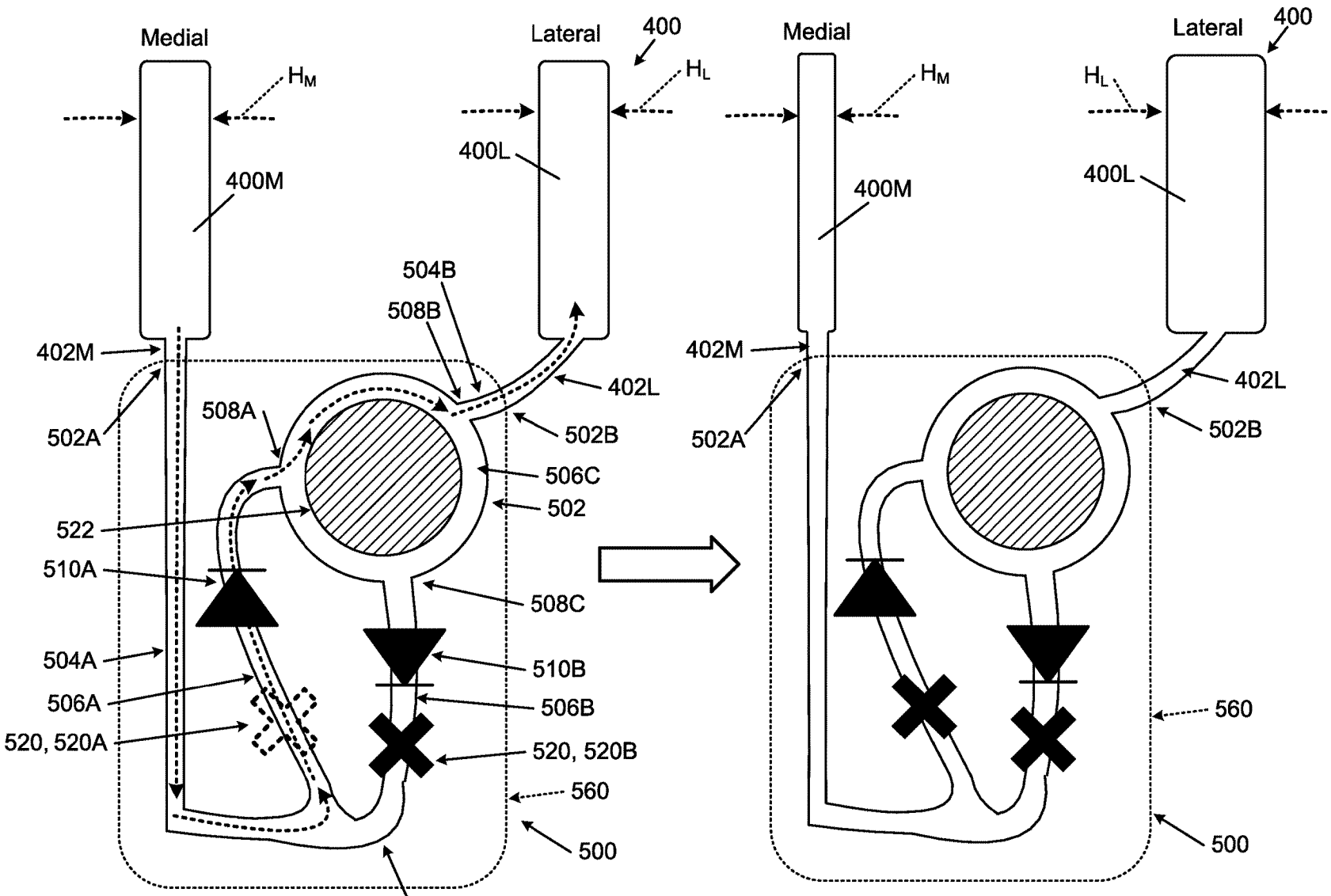
FIGS. 5A and 5B provide schematic diagrams of the foot support system of FIG. 4A in two different fluid flow configurations.
Figure 5B:
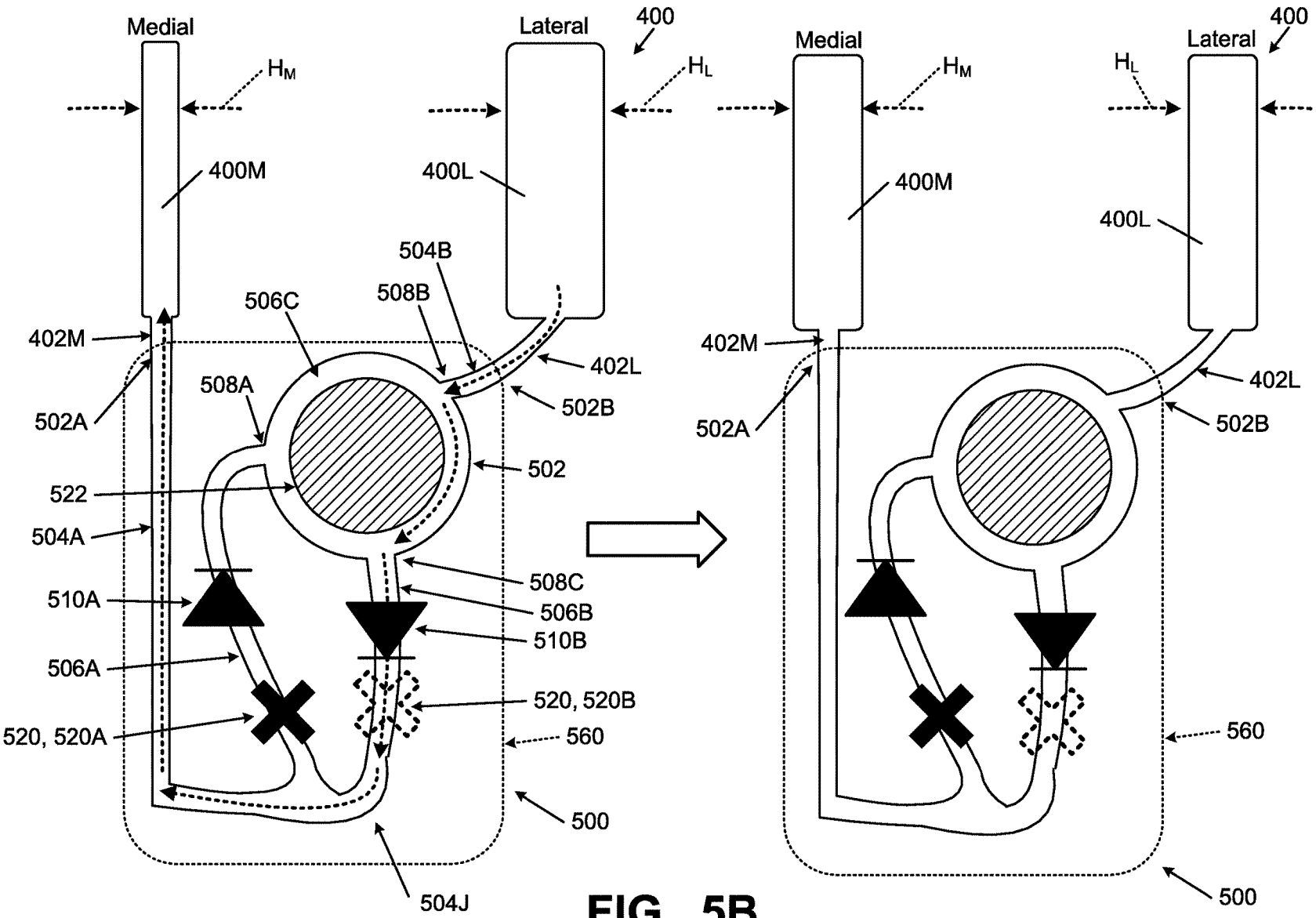

In the first fluid flow path, as shown in the example of FIG. 5A, fluid moves: (a) from the first side foot support bladder 400M, (b) through the first fluid line 402M, (c) through the first port 502A, (d) through the fluid flow control system 500 to the second port 502B, (e) through the second port 502B, (f) through the second fluid line 402L, and (g) into the second side foot support bladder 400L. This action: (a) decreases the height $H_M$ of the first side foot support bladder 400M and (b) increases the height $H_L$ of the second side foot support bladder 400L. In the second fluid flow path, as shown in the example of FIG. 5B, fluid moves: (a) from the second side foot support bladder 400L, (b) through the second fluid line 402L, (c) through the second port 502B, (d) through the fluid flow control system 500 to the first port 502A, (e) through the first port 502A, (f) through the first fluid line 402M, and (g) into the first side foot support bladder 400M. This action: (a) increases the height $H_M$ of the first side foot support bladder 400M and (b) decreases the height $H_L$ of the second side foot support bladder 400L.

Figure 4B:
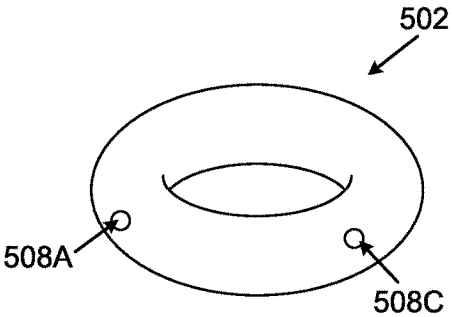
FIGS. 4B and 4C illustrate example configurations of a fluid distributor for use in foot support systems in accordance with some aspects of this technology.
Figure 4C:
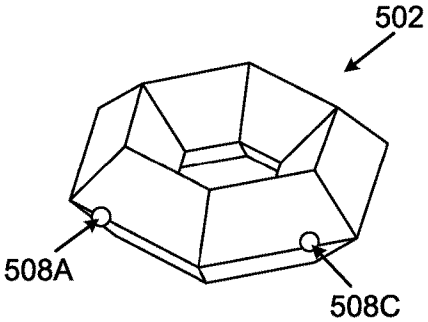
Figure 4A:
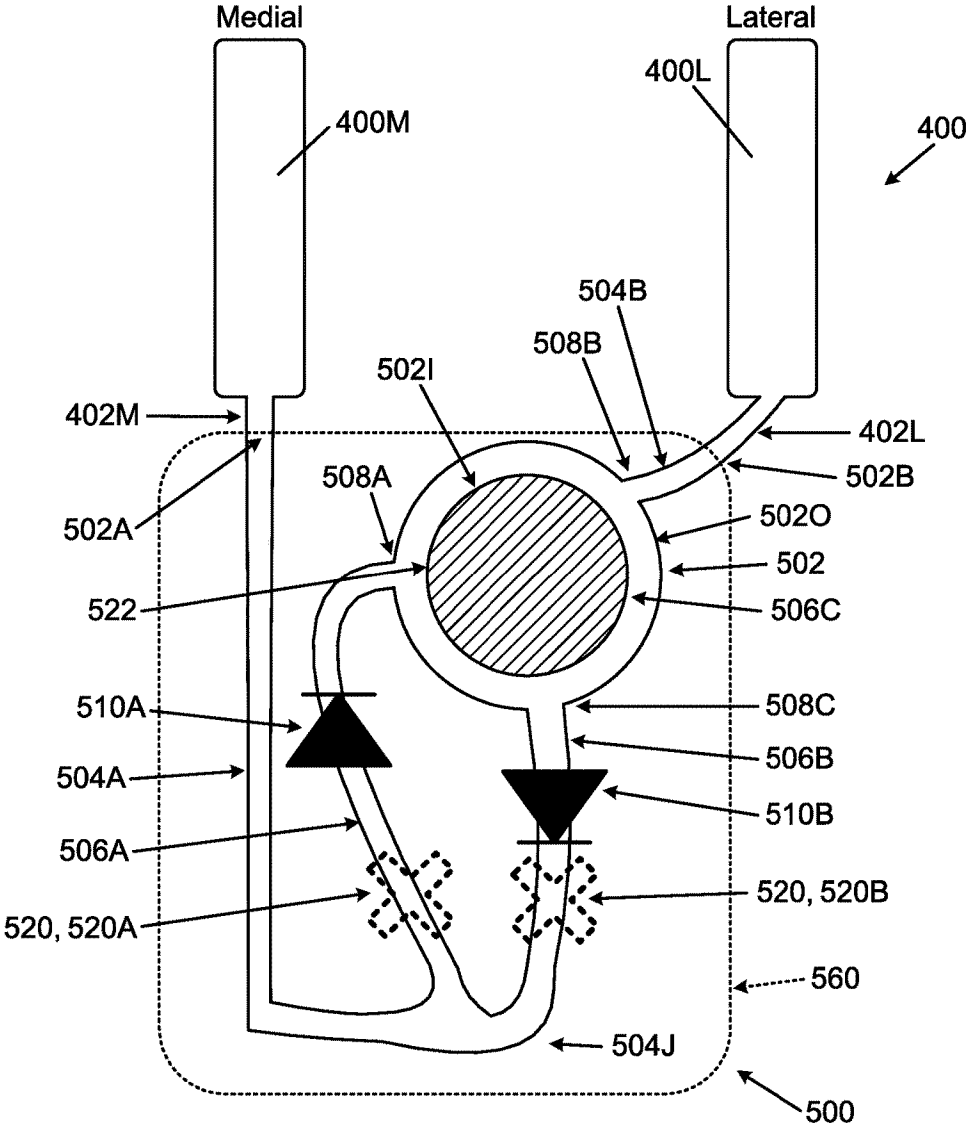
FIG. 4A provides a schematic diagram of a foot support system in accordance with some aspects of this technology.

The fluid flow control system 500 of this example further includes one or more fluid control devices. More specifically, these fluid control devices may include at least one of: (a) one or more valves (e.g., two valves 510A and 510B (e.g., one-way valves or check valves) are shown in FIGS. 4A, 5A, and 5B) and/or (b) one or more switches 520 (shown schematically by the large "X's" 520A and 520B in FIGS. 4A, 5A, and 5B). The one or more fluid control devices (e.g., valves 510A, 510B and/or switches 520, etc.) are configured to selectively and individually place the fluid flow control system 500 at least in: (i) a first configuration in which the first fluid flow path is open while the second fluid flow path is closed (see FIG. 5A), and (ii) a second configuration in which the second fluid flow path is open while the first fluid flow path is closed (see FIG. 5B). The fluid flow control system 500 of this illustrated example includes a first path portion 504A that extends from first port 502A to a junction area 504J. Junction area 504J branches into: (a) a first fluid distributor path 506A leading to a first inlet/outlet port 508A of fluid distributor 502 and (b) a second fluid distributor path 506B leading to a third inlet/outlet port 508C of fluid distributor 502. A fluid path through the fluid distributor 502 may be considered a third fluid distributor path 506C (e.g., that joins a second inlet/outlet 508B of fluid distributor 502 at least with the third inlet/outlet 508C). A second path portion 504B, if needed, may join second inlet/outlet 508B with second port 502B (alternatively, if desired, second inlet/outlet 508B and second port 502B may constitute the same or share portions of the same physical structure). Valves 510A and 510B are included in first fluid distributor path 506A and second fluid distributor path 506B, respectively. Switch(es) 520 can selectively open and close first fluid distributor path 506A (note item 520A) and the second fluid distributor path 506B (note item 520B). The second port 502B is connected to the second fluid-filled bladder 400L via second fluid line 402L.

Valve 510A may constitute a one-way valve or check valve type structure. This valve 510A may be positioned, structured, and configured to allow fluid to flow in a direction from the first fluid-filled bladder 400M toward the junction area 504J and/or the distributor 502 (e.g., provided any pre-set valve crack pressure, if any, is exceeded) via first fluid distributor path 506A but prevent fluid flow along the first fluid distributor path 506A in a direction from the distributor 502 toward the junction area 504J and/or the first fluid-filled bladder 400M. Similarly, valve 510B may constitute a one-way valve or check valve type structure. This valve 510B may be positioned, structured, and configured to allow fluid to flow in a direction from the fluid distributor 502 toward the junction area 504J and the first fluid-filled bladder 400M (e.g., provided any pre-set valve crack pressure, if any, is exceeded) via second fluid distributor path 506B but prevent fluid flow along the second fluid distributor path 506B in a direction from the junction area 504J and/or the first fluid-filled bladder 400M toward the distributor 502.

In the first configuration for fluid flow shown in FIG. 5A, the switch(es) 520 is (are) set to keep the first fluid distributor path 506A open (shown by the open and broken line "X" 520A in FIG. 5A) and second fluid distributor path 506B closed (shown by the blackened "X" 520B in FIG. 5A). Thus, fluid flows through the broken line path from the first fluid-filled bladder 400M to the second fluid-filled bladder 400L via distributor 502. Fluid is prevented from returning to the first fluid-filled bladder 400M in this configuration by the valve 510A and the closed path at 520B. In this first configuration, fluid flows to second fluid-filled bladder 400L from first fluid-filled bladder 400M until it is stopped (e.g., by another valve or switch, by electronic control, etc.) and/or released in some manner (e.g., by moving the switch(es) 520 to open at X 520B). In the second configuration for fluid flow shown in FIG. 5B, the switch(es) 520 is (are) set to keep the second fluid distributor path 506B open (shown by the open and broken line "X" 520B in FIG. 5B) and first fluid distributor path 506A closed (shown by the blackened "X" 520A in FIG. 5B). Thus, fluid flows through the broken line path from the second fluid-filled bladder 400L to the first fluid-filled bladder 400M via distributor 502. Fluid is prevented from returning to the second fluid-filled bladder 400L in this configuration by the valve 510B and the closed path at 520A. In this second configuration, fluid flows to first fluid-filled bladder 400M from second fluid-filled bladder 400L until it is stopped (e.g., by another valve or switch, by electronic control, etc.) and/or released in some manner (e.g., by moving the switch(es) 520 to open at X 520A).

Additionally or alternatively, if desired, the fluid flow control system 500 of this example may be selectively placed in a third configuration in which both the first fluid flow path and the second fluid flow path are simultaneously open. This may be accomplished by positioning switch(es) 520 to open first fluid distributor path 506A at X 520A and to open second fluid distributor path 506B at X 520B (e.g., both X's at 520A and 520B provided as broken lines, e.g., as shown in FIG. 4A). In this configuration, fluid can freely flow throughout this example fluid foot support system 400 and this example fluid flow control system 500. Such a configuration may be useful to support more natural motion, such as walking, running, etc. and/or to equalize pressure in the overall fluid foot support system 400.

Still further additionally or alternatively, if desired, the fluid flow control system 500 of this example may be selectively placed in another (e.g., a third or fourth configuration) in which both the first fluid flow path and the second fluid flow path are simultaneously closed. This may be accomplished by positioning switch(es) 520 to close first fluid distributor path 506A at X 520A and to close second fluid distributor path 506B at X 520B (e.g., both X's at 520A and 520B provided as solid, blackened X's as shown at the right side of FIG. 5A). In this configuration, fluid is substantially held in place (e.g., locked into place) throughout this example fluid foot support system 400 and this example fluid flow control system 500. Such a configuration may be useful to hold the fluid pressures in the bladders 400M, 400L at substantially constant pressures (e.g., ±10% of a set pressure) for a desired time period (e.g., during the period of a golf swing, etc.).

Figure 2A:
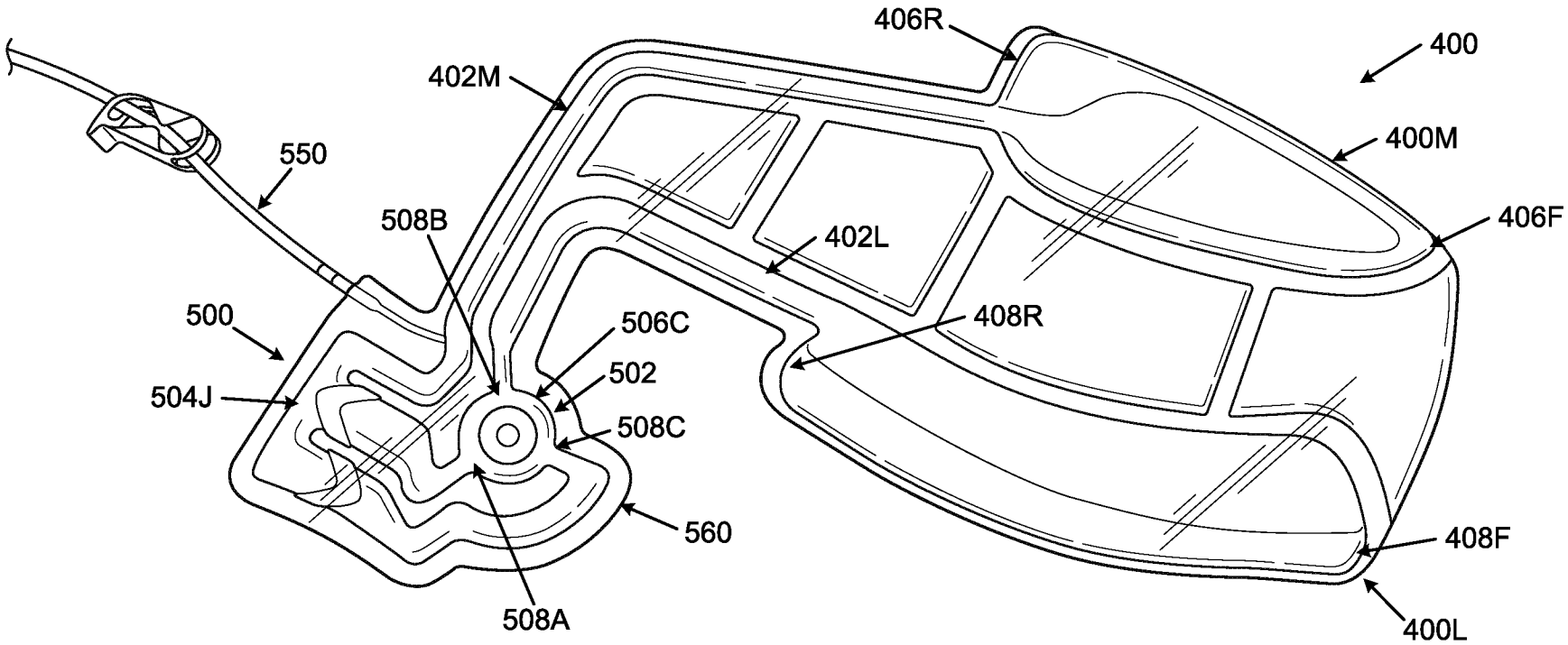
FIGS. 2A-2C provide various views of the foot support system included in the article of footwear of FIGS. 1A-1C.
Figure 2B:
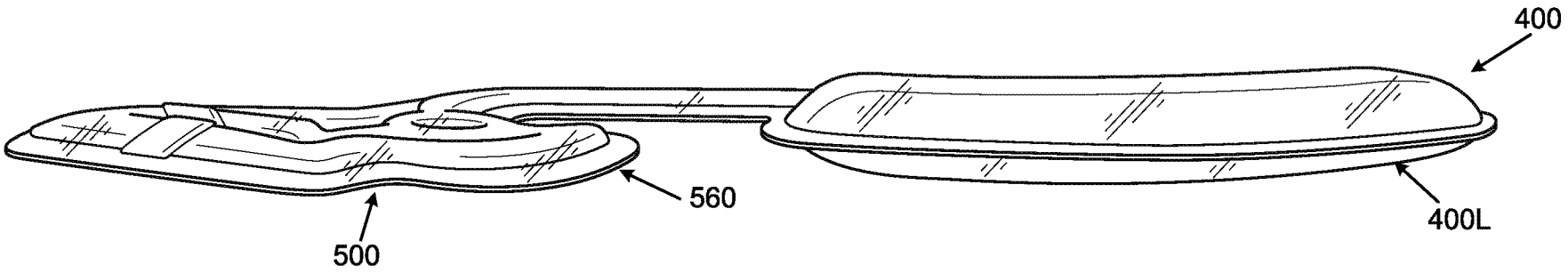
Figure 2C:
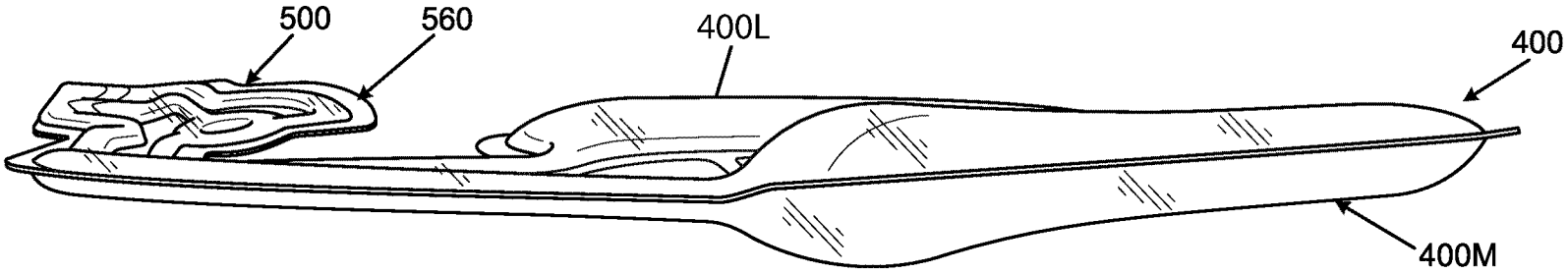

The fluid-filled bladders 400M, 400L may be separate components or formed as part of a single structure, optionally along with at least some portions of the fluid flow control system 500. FIGS. 2A-2C illustrate an example of such a single structure. The bladder(s) 400M, 400L, and/or fluid flow control system 500 may be made, at least in part, from conventional bladder materials and/or conventional fabrication techniques as are known and used in the footwear arts. In the example of FIGS. 2A-2C, the bladder(s) 400M, 400L, and fluid paths included with them and/or in the fluid flow control system 500 are thermoformed, using heat and pressure, from two sheets (or one folded sheet) of thermoplastic material as conventionally used in the footwear bladder arts. Size(s) and/or shape(s) of the internal chambers of one or more of the bladder(s) 400M, 400L, and/or one or more of the fluid paths included with them and/or in the fluid flow control system 500 may be controlled, e.g., by selectively bonding the top internal surface to the bottom internal surface in the interior chamber(s), by bonding tensile elements or other internal components to interior surfaces of the internal chambers, etc. Use of such internal bonds, tensile elements, and/or other internal components to control bladder and fluid line shape are known in the art. Tensile elements are shown in bladders 400L, 400M of FIGS. 2A-2C. Line 550 in FIG. 2A constitutes an inflation line used to initially and/or periodically add fluid to the fluid foot support system 400 and/or the fluid flow control system 500 (e.g., connected to a pump, an external gas source, a reservoir bladder, etc.).

Figure 3A:
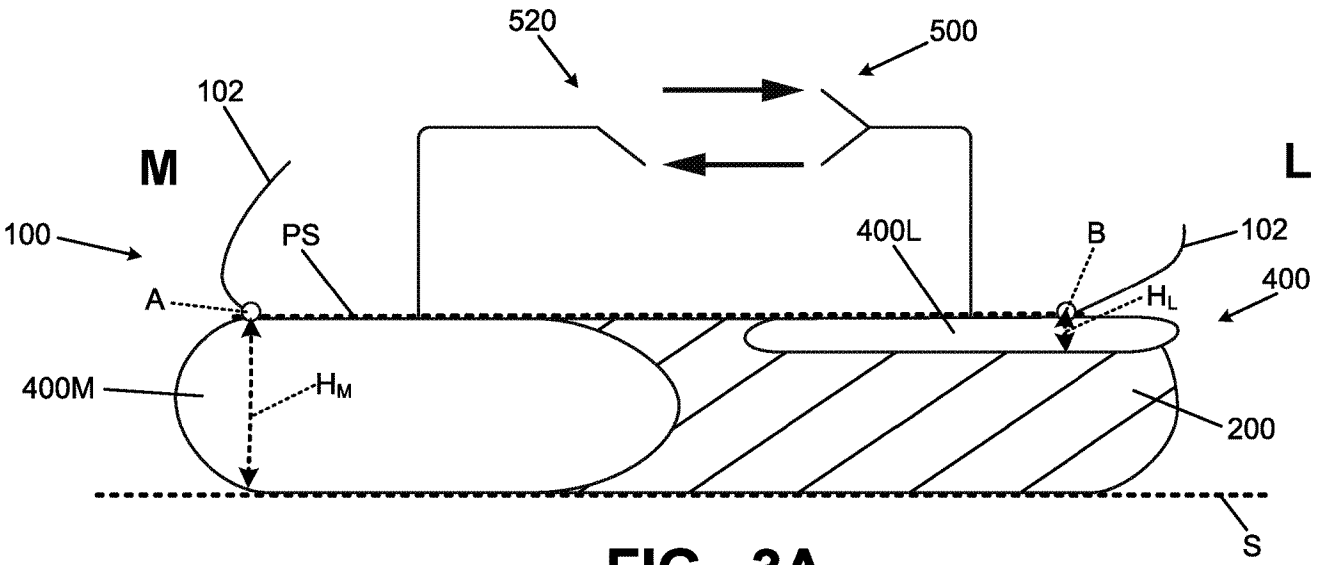
FIGS. 3A and 3B provide transverse cross sectional views across example foot support systems in accordance with aspects of this technology in two fluid flow configurations.
Figure 3B:
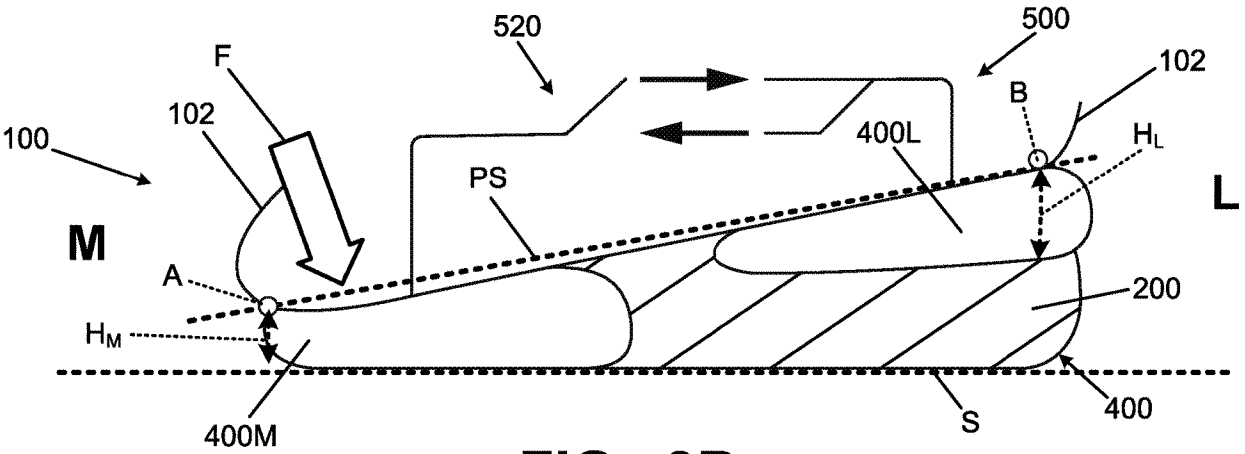

FIGS. 3A and 3B provide cross sectional views across a forefoot area of an article of footwear 100 of the types illustrated in FIGS. 1A-1C to show the effect of movement of fluid in fluid foot support systems 400 in accordance with some aspects of this technology. In FIG. 3A, the fluid foot support system 400 is in the configuration shown at the left side of FIG. 5A and in the right side of FIG. 5B in which the first side fluid-filled bladder 400M is in a relatively high height configuration and the second side fluid-filled bladder 400L is in a relatively low height configuration. In the configuration shown in FIG. 3A, the fluid foot support system 400, sole structure 104, and/or article of footwear 100 is supported on a horizontal support surface S. In this arrangement, at least a portion of the plantar support surface PS of the fluid foot support system 400, sole structure 104, and/or article of footwear 100 (at a transverse cross section location in the forefoot region) will extend in a transverse direction parallel to or at a first angle with respect to the horizontal support surface S. In making an angular determination, if no clear flat plantar support surface in the transverse direction can be located, the orientation of the plantar support surface PS at the transverse cross section location may be considered as a line connecting the endpoints A and B where the sidewall of the upper 102 joins or meets the upper-facing surface of the sole structure 104 and/or at the outer edges of the foot-receiving chambers 106 at the transverse cross sectional location. The first angle between the plantar support surface PS and the horizontal base surface S in this orientation may be, for example, in the range of 0 degrees to 10 degrees, and in some examples between 0 degrees and 5 degrees (e.g., substantially flat or horizontal). The plantar support surface PS may constitute the top of midsole component 200, the top of a strobel component inside or forming the bottom of the upper 102, a plate located above top surface of bladders 400M, 400L and/or midsole component 200, etc.

In FIG. 3B, the fluid foot support system 400 is in the configuration shown at the right side of FIG. 5A and the left side of FIG. 5B in which the first side fluid-filled bladder 400M is in a relatively low height configuration and the second side fluid-filled bladder 400L is in a relatively high height configuration. In the configuration shown in FIG. 3B, the fluid foot support system 400, sole structure 104, and/or article of footwear 100 is supported on a horizontal support surface S. In this arrangement, at least a portion of the plantar support surface PS of the fluid foot support system 400, sole structure 104, and/or article of footwear 100 (at a transverse cross section location in the forefoot region) will extend in a transverse direction at a second angle with respect to the horizontal support surface S. The second angle in this arrangement is greater than the first angle, thereby causing the plantar support surface PS to tilt inward and downward as compared to the orientation in FIG. 3A. The second angle between the plantar support surface PS and the horizontal base surface S in this orientation may be, for example, in the range of 2 degrees to 20 degrees, and in some examples between 2.5 degrees and 15 degrees or even between 3 degrees and 12 degrees. The second angle may be greater than the first angle, for example, by 2 to 18 degrees, and in some examples, by 2 degrees to 16 degrees, 2 degrees to 12 degrees, or even 2 degrees to 10 degrees.

The height $H_M$ and/or $H_L$ differences between the first orientation (e.g., of FIG. 3A) and the second orientation (e.g., of FIG. 3B) may take on any desired values to accomplish the angular changes, e.g., as described above. As some more specific examples, in at least one transverse cross sectional location, the height $H_M$ of the first side fluid-filled bladder 400M in its high height configuration (FIG. 3A) may be at least 3 mm higher, and in some examples, at least 5 mm higher, at least 7.5 mm higher, at least 10 mm higher, at least 15 mm higher, or even at least 20 mm higher than its height $H_M$ at the same transverse cross sectional location in its low height configuration (FIG. 3B). The height $H_M$ of the first side fluid-filled bladder 400M in its high height configuration (FIG. 3A) in at least one transverse cross sectional location may be between 3 mm and 25 mm, and in some examples, between 5 mm and 25 mm, between 7.5 mm and 20 mm, or even between 10 mm and 18 mm. The height $H_M$ of the first side fluid-filled bladder 400M in its low height configuration (FIG. 3B) in at least one transverse cross sectional location may be between 0 mm and 15 mm, and in some examples, between 1 mm and 12 mm, or even between 1.5 mm and 10 mm. These height measurements may be made at the exterior edge and/or a greatest height change location of the first side fluid-filled bladder 400M of the fluid foot support system 400.

Additionally or alternatively, as some more specific examples, in at least one transverse cross sectional location, the height $H_L$ of the second side fluid-filled bladder 400L in its high height configuration (FIG. 3B) may be at least 5 mm higher, and in some examples, at least 7.5 mm higher, at least 10 mm higher, at least 15 mm higher, or even at least 20 mm higher than its height $H_L$ at the same transverse cross sectional location in its low height configuration (FIG. 3A). The height $H_L$ of the second side fluid-filled bladder 400L in its high height configuration (FIG. 3B) in at least one transverse cross sectional location may be between 5 mm and 25 mm, and in some examples, between 7.5 mm and 20 mm, or even between 10 mm and 18 mm. The height $H_L$ of the second side fluid-filled bladder 400L in its low height configuration (FIG. 3A) in at least one transverse cross sectional location may be between 0 mm and 15 mm, and in some examples, between 1 mm and 12 mm, or even between 1.5 mm and 10 mm. These height measurements may be made at the exterior edge and/or a greatest height change location of the second side fluid-filled bladder 400L of the fluid foot support systems 400.

If necessary or desired, the sidewall(s) and/or other portions of bladder 400M and/or 400L may include structure, such as bellows, folds, or accordion type structure, to enable increase or decrease in heights $H_M$ and/or $H_L$ and/or to control the structure shape as the heights change. Additionally or alternatively, internal tensile elements within bladder 400M and/or 400L internal chambers may be used to control bladder height(s) $H_M$ and/or $H_L$ and/or plantar support surface PS tilt angles under different inflation configurations or conditions.

FIGS. 1A-1C further illustrate that the midsole component 200 of this example includes forefoot openings on the medial side (opening 202M) and the lateral side (opening 202L) to accommodate increases and decreases in bladder 400M, 400L heights $H_M$, $H_L$ under different inflation configurations or conditions. If desired, one or more elastic members 204 could be attached to the upper 102, midsole 200, and/or sole structure 104 to bridge the opening(s) 202M and/or 202L and bias the opening(s) 202M and/or 202L toward a more closed arrangement (e.g., when insufficient bladder pressure pushes them apart). Additionally or alternatively, if desired, either or both of the openings 202M, 202L could be replaced in whole or in part by an expandable structure, such as a bellow, fold, or accordion type structure.

In at least some examples of this technology, the rearward end 202MR of medial side opening 202M (see FIG. 1B) and/or the rearward end 406R of the medial side fluid-filled bladder 400M (see FIG. 2A) may be located: (a) forward of a parallel plane located at P=0.45L, (b) forward of a parallel plane located at P=0.5L, (c) rearward of a parallel plane located at P=0.72L, and/or (d) rearward of a parallel plane located at P=0.68L. Additionally or alternatively, the forward end 202MF (see FIG. 1B) of medial side opening 202M and/or the forward end 406F of the medial side fluid-filled bladder 400M (see FIG. 2A) may be located: (a) forward of a parallel plane located at P=0.8L, (b) forward of a parallel plane located at P=0.85L, (c) rearward of a parallel plane located at P=0.98L, and/or (d) rearward of a parallel plane located at P=0.95L. These parallel plane locations are measured forward from a rearmost heel location RH of the article of footwear 100 and/or sole structure 104.

Additionally or alternatively, in at least some examples of this technology, the rearward end 202LR of lateral side opening 202L (see FIG. 1A) and/or the rearward end 408R of the lateral side fluid-filled bladder 400L (see FIG. 2A) may be located: (a) forward of a parallel plane located at P=0.40L, (b) forward of a parallel plane located at P=0.44L, (c) rearward of a parallel plane located at P=0.68L, and/or (d) rearward of a parallel plane located at P=0.64L. Additionally or alternatively, the forward end 202LF (see FIG. 1A) of lateral side opening 202L and/or the forward end 408F of the lateral side fluid-filled bladder 400L (see FIG. 2A) may be located: (a) forward of a parallel plane located at P=0.84L, (b) forward of a parallel plane located at P=0.88L, (c) rearward of a parallel plane located at P=1L, and/or (d) rearward of a parallel plane located at P=0.96L. These parallel plane locations are measured forward from a rearmost heel location RH of the article of footwear 100 and/or sole structure 104.

Fluid distributor 502, when present, may take on any desired size, volume, and/or shape without departing from this technology (e.g., cylinder, toroid, bulb, etc.). As shown in FIG. 4A, this example fluid distributor 502 includes an outer wall 502O through which each of the first inlet/outlet 508A, the second inlet/outlet 508B, and the third inlet/outlet 508C extends. This example fluid distributor 502 further includes an inner wall 502I or component contained within and spaced from the interior surface of outer wall 502O. FIG. 4B shows a perspective view of one example of such a fluid distributor 502 having a toroidal shape in the shape of a torus (e.g., "doughnut" shaped). FIG. 4C shows a perspective view of one example of such a fluid distributor 502 having a toroidal polyhedron shape. Other desired reservoirs and/or distributors 502 having different sizes, shapes, and/or volumes may be used in some examples of this technology. If desired, the inner wall 502I may be omitted in some examples, thereby providing more of a non-toroidal type reservoir, such as a cylinder. Additionally or alternatively, in some examples, the inner wall 502I may be formed, at least in part, by a surface of a switch 520. See FIGS. 8A-8D. The fluid distributor 502 in accordance with at least some examples of this technology may be made from the same material(s) and/or formed as an integral part with: (a) one or both side fluid-filled bladders 400M, 400L, (b) other parts of the fluid flow control system 500, and/or (c) any of the fluid lines described relating to these component parts. Alternatively, fluid distributor 502 may be formed as a separate part that is engaged with the fluid line(s).

FIGS. 2A-2C, 4A, 5A, and 5B show the fluid flow control system 500 formed (e.g., thermoformed from sheet(s) of thermoplastic material bonded by heat and pressure) as a unit forming a base 560. Alternatively, if desired, this base 560 could be formed as one or more separate components to which at least some portion of the fluid flow control system 500 is attached. In some examples, this base 560 may form a base for mounting at least a portion of the fluid flow control system 500 (e.g., the fluid distributor 502 and/or other portions) to another footwear component, such as upper 102 (see FIGS. 1A and 1C) and/or sole structure 104. Any means for attaching these various parts may be used without departing from this technology, such as one or more of adhesives, fusing techniques, mechanical connectors, etc.

Figure 7:
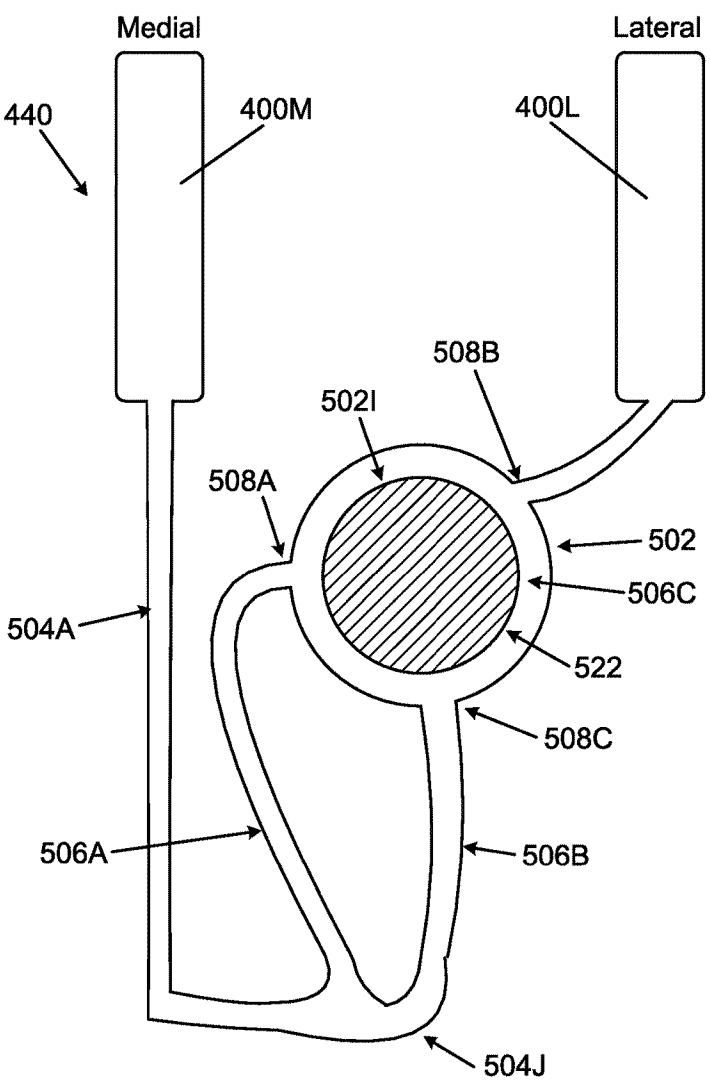
FIGS. 6 and 7 provides schematic diagrams of additional example foot support systems in accordance with some aspects of this technology.
Figure 6:
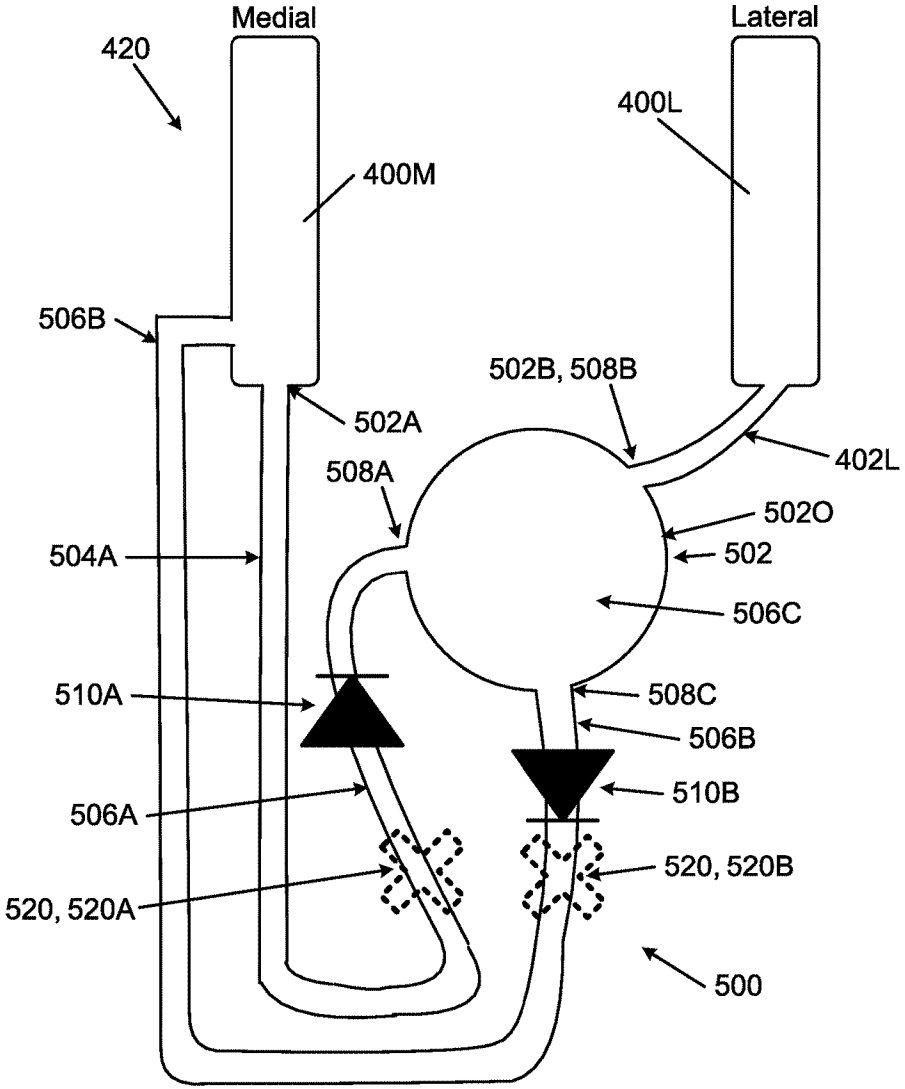

FIGS. 6 and 7 illustrate other examples of fluid foot support systems 420, 440, respectively, in accordance with aspects of this technology. Where FIGS. 6 and/or 7 include reference numbers the same as those included in FIGS. 1A-5B, the same or similar parts are being referenced (including any disclosed characteristics, properties, variations, modifications, options and/or potential changes thereto), and some or all of the detailed repetitive description thereof may be omitted. The description below focuses on some structural differences between the fluid foot support systems 420, 440 of FIGS. 6 and 7 as compared to the fluid foot support systems 400 described above.

As one example, the fluid flow control systems 500 of these examples are not mounted on a base 560, although they could be if desired. In the example of FIG. 6, the inner wall 502I of the fluid distributor 502 is omitted, and the fluid distributor 502 takes the form of an open reservoir, such as a short cylinder (although the same types of toroidal structures described above may be used in the example of FIG. 6, if desired). The second inlet/outlet 508B of the fluid distributor 502 of this example merges to form the second port 502B of the fluid flow control system 500 which is integrally formed or engaged with second fluid line 402L in this example. Also, the first port 502A of the fluid flow control system 500 merges to connect directly to the first side fluid-filled bladder 400M in this example. If desired, any one or more of these structural changes could be incorporated into the fluid flow control system 500 of FIGS. 1A to 5B, and/or any one or more of the related structures from fluid flow control system 500 of FIGS. 1A to 5B could be incorporated into the fluid flow control system 500 of FIG. 6.

Another difference in the fluid flow control system 500 of the fluid foot support system 420 of FIG. 6 relates to fluid paths into the first fluid distributor path 506A and the second fluid distributor path 506B. In the example of FIGS. 4A, 5A, and 5B, fluid line 506B connects the third inlet/outlet 508C of distributor 502 to the first fluid path portion 504A at junction 504J which then connects to first fluid line 402M which then connects to first side fluid-filled bladder 400M. Thus, as shown in FIGS. 5A and 5B, both the first fluid flow path from the first side fluid-filled bladder 400M to the second side fluid-filled bladder 400L and the second fluid flow path from the second side fluid-filled bladder 400L to the first side fluid-filled bladder 400M shared the same fluid path through fluid flow control system 500 from the junction area 504J to the first side fluid-filled bladder 400M (i.e., first path portion 504A is shared in the fluid flow paths of FIGS. 5A and 5B).

That specific structure is not a requirement. Rather, as shown in FIG. 6, instead of fluid path junction area 504J, second fluid path portion 506B from the third inlet/outlet 508C forms a separate line that connects independently to the first side fluid-filled bladder 400M. Second fluid path portion 506B may use the same port into first side fluid-filled bladder 400M as first fluid path portion 504A or it may use a different port (as shown in FIG. 6).

Figure 3C:
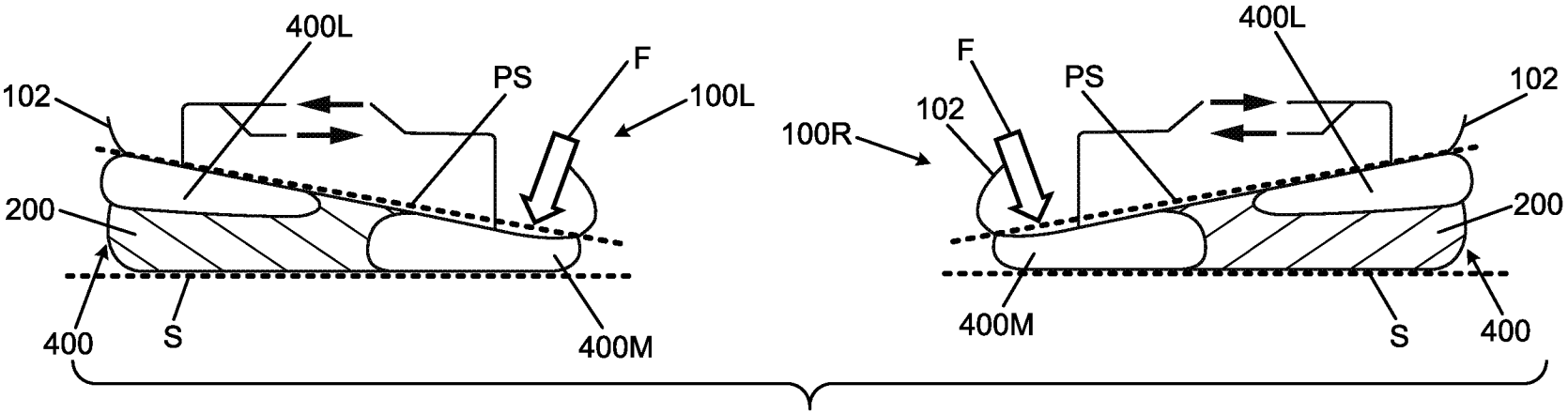
FIG. 3C shows a pair of foot support systems oriented in a golf stance in one aspect of this technology.

In some examples of this technology, when the first fluid path is open, the desired fluid shift (from the first side fluid-filled bladder 400M to the second side fluid-filled bladder 400L) and plantar support surface PS tilt occurs by the manner in which the user's weight is positioned on the sole structure 104. For example, when setting up for a golf swing as shown in FIG. 3C, the golfer stands aside the ball with the left shoe 100L spread apart from the right shoe 100R. Aspects of this technology allow the golfer to apply a downward and optionally outward force F at the forefoot region (e.g., beneath the first metatarsal head area of each foot—at the forefoot, medial side of the sole) to firmly engage the sole structures 104 with the ground. When the first fluid path is open (e.g., as shown in FIG. 5A), the plantar support surfaces PS tilt inward and downward as shown in FIG. 3C and the fluid shifts from the medial side to the lateral side of each shoe 100L, 100R. This action helps the wearer more squarely apply the downward and outward force F in a more perpendicular direction to the plantar support surface PS providing a very solid and stable base and feel to support the golf swing.

In the example of FIGS. 1A to 5B, once the fluid shifts from the medial side to the lateral side (FIGS. 3B and 5A), it can be returned (to the configuration of FIGS. 3A and 5B) by moving the switch 520 to open the second fluid path (and, if desired, to maintain both fluid paths open). Such a switching system may not be needed in all examples of this technology. For example, FIG. 7 shows a fluid foot support system 440 similar to those described above in conjunction with FIGS. 1A-5B, but with the valves 510A, 510B and switching system 520 removed. Those valving and switching structural features may be removed from the example fluid foot support system 420 (and options thereof) of FIG. 6 as well. In the fluid foot support system 440 of FIG. 7, fluid is allowed to move at any time within the fluid foot support system 440 through either of the first and/or second fluid paths, e.g., based on the way force is applied to the fluid-filled bladders 400M, 400L. For example, when setting up for a golf swing as described above in conjunction with FIG. 3C, the downward and optionally outward force F applied at the forefoot region (e.g., beneath the first metatarsal head area of each foot—at the forefoot, medial side of the sole) still will be adequate to move the fluid from the medial side to the lateral side and produce the desired plantar support surface PS tilt shown in FIGS. 3B and 3C. In some examples of this type of fluid foot support system 440, the fluid path sizes (e.g., diameter and/or length in at least some portion of the second fluid path portion 506B) and/or path shape may be selected to produce a slower and more deliberate return of fluid from the lateral side to the medial side (back to FIG. 3A), e.g., to prevent an abrupt shifting of fluid with slight relative pressure changes and/or to somewhat slowly move from the FIG. 3B tilt to the FIG. 3A flatter configuration over a longer time period and/or over a few steps. Additionally or alternatively, baffles, valving, a meandering path, and/or other structures may be provided, e.g., along the second fluid flow path portion 506B to provide a more controlled transfer of fluid from the lateral side to the medial side, in at least some examples of this technology. These structural features may help maintain the desired tilt of FIGS. 3B and 3C for a longer time, e.g., throughout the entire length of the golf swing, while still allowing the fluid to equalize and support natural motion without complicated switching and/or a need for user or electronic control of switches or valves.

As described above, however, some examples of this technology may include a switch or switching system to selectively open and close one or more of the desired fluid paths. More specific examples of the switching systems in this technology, when present, will enable fluid to provide any one or more of the following actions: (a) to selectively move fluid from the medial forefoot side of the fluid foot support system 400, 420, 440 to the lateral forefoot side thereof when desired (e.g., open the "first fluid path" and close the "second fluid path"); (b) to selectively move fluid from the lateral forefoot side of the fluid foot support system 400, 420, 440 to the medial forefoot side thereof when desired (e.g., open the "second fluid path" and close the "first fluid path"); (c) to selectively open both fluid paths in the fluid foot support system 400, 420, 440 (e.g., open both the "first fluid path" and the "second fluid path" to equalize pressure in the fluid foot support system 400, 420, 440 or allow free transfer of fluid under natural foot motion); and/or (d) to selectively close all fluid paths in the fluid foot support system 400, 420, 440 (e.g., close both the "first fluid path" and the "second fluid path" to substantially lock a specific pressurized configuration in place). Any desired type of switching and/or valving may be used to accomplished these various and selective fluid path openings and closings.

FIGS. 8A-8D illustrate an example of one switching system 520 that may be used in conjunction with a fluid distributor 502 to selectively open and close the first and second fluid paths described above (e.g., and as shown in FIGS. 5A and 5B). A switch activator 522 (e.g., a dial or disc) may be movably (e.g., rotatably) mounted at least partially within the outer wall 502O. The switch activator 522 may include a handle 524 (e.g., raised handle, recessed slot, etc.) for manual interaction and/or it may be electronically controlled (e.g., from a mobile telephone application program, from a smart phone, or from another type of computing device). A portion of the exterior perimeter 522P of switch activator 522 may form "inner wall" 502I described above. Movement of the switch activator 522 in this example structure moves the inner wall 502I with respect to the outer wall 502O. The exterior perimeter 522P may include one or more raised surfaces or other structures that function as stop elements to selectively close one or more of the inlet/outlets 508A, 508C (and optionally inlet/outlet 508B). Four such raised surfaces 522A, 522B, 522C, and 522D are shown in FIGS. 8A-8D, but more or fewer could be provided, e.g., provided the desired path opening and closing functions can be performed. These raised surfaces 522A, 522B, 522C, and 522D also may be considered and/or are called "stop elements" in this specification used to stop fluid flow in a portion of the fluid foot support system 400 (e.g., through inlet/outlets 508A, 508C). The operation of this example switching system 520 now will be described.

Figure 8A:
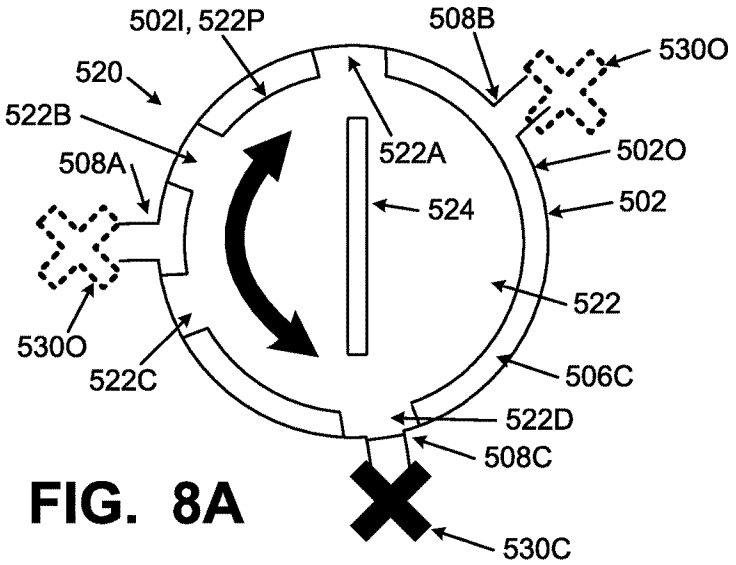
FIGS. 8A-8D provide diagrams illustrating an example switching system for a fluid flow control system to place a foot support system in two different fluid flow configurations in accordance with some examples of this technology.

To open the "first fluid path" described above (e.g., FIG. 5A), the switch activator 522 is located at the position shown in FIG. 8A. In this arrangement, raised surface 522D is positioned to seal off the third inlet/outlet 508C of the fluid distributor 502 (shown by black "X" 530C in FIG. 8A and black "X" 520B in FIG. 5A) and the first inlet/outlet 508A and the second inlet/outlet 508B remain open (shown by broken "X's" 530O in FIG. 8A and broken "X" 520A in FIG. 5A). Raised surfaces 522A, 522B, and 522C do not block any of the inlet/outlets of fluid distributor 502 in this configuration. Thus, in this configuration, the switching system 520 enables fluid to move from the medial forefoot side of the fluid foot support system 400, 420, 440 (from first side fluid-filled bladder 400M) to the lateral forefoot side thereof (to the second side fluid-filled bladder 400L), the "first fluid path" is open, and the "second fluid path" is closed. Fluid can still move through the distributor 502, e.g., in an axial direction (into and out of the page of FIG. 8A) around the other raised surfaces 522A, 522B, and 522C and the switch activator. Fluid is prevented from flowing backward out of inlet/outlet 508A by valve 510A (see FIG. 5A).

Figure 8B:
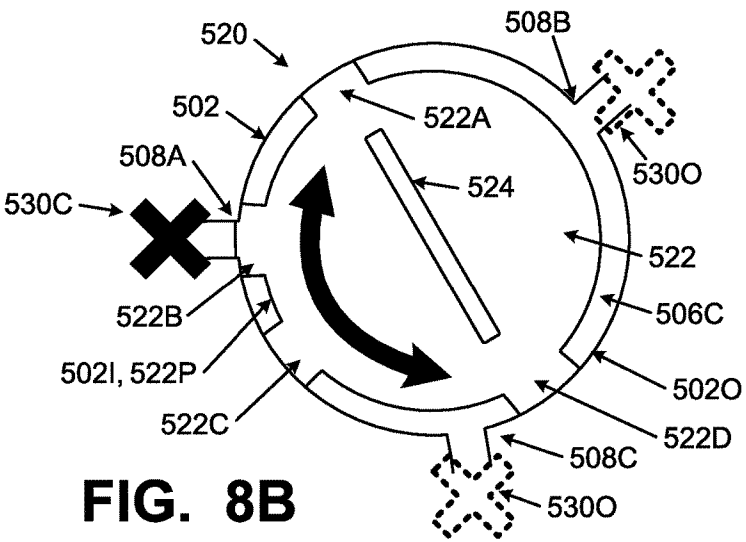

When the switching system 520 is moved (e.g., rotated) to the position shown in FIG. 8B, raised surface 522D moves away from the third inlet/outlet 508C of the fluid distributor 502 thereby opening the third inlet/outlet 508C (shown by broken "X" 530O in FIG. 8B and broken "X" 520B in FIG. 5B) and the second raised surface 522B moves to seal off and close the first inlet/outlet 508A (shown by black "X" 530C in FIG. 8B and black "X" 520A in FIG. 5B). The second inlet/outlet 508B remains open (shown by broken "X" 530O). Raised surfaces 522A and 522C also do not block any of the inlet/outlets of fluid distributor 502 in this configuration. This opens the "second fluid path" described above (FIG. 5B). Thus, in this configuration, the switching system 520 enables fluid to move from the lateral forefoot side of the fluid foot support system 400, 420, 440 (from second side fluid-filled bladder 400L) to the medial forefoot side thereof (to the first side fluid-filled bladder 400M), the "second fluid path" is open, and the "first fluid path" is closed. Fluid is prevented from flowing backward into inlet/outlet 508C by valve 510B (see FIG. 5B).

Figure 8C:
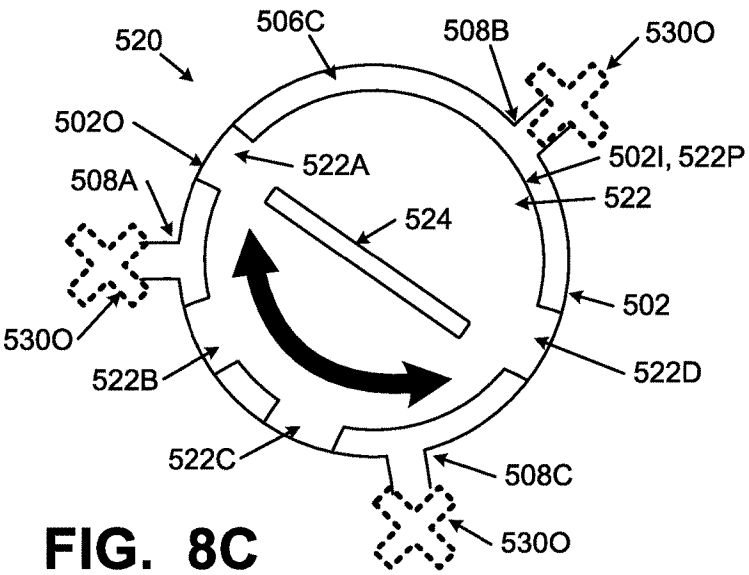

When the switching system 520 is moved (e.g., rotated) to the position shown in FIG. 8C, raised surface 522B moves away from the first inlet/outlet 508A of the fluid distributor 502 thereby opening the first inlet/outlet 508A (shown by broken "X" 530O). The other raised surfaces 522A, 522C, and 522D also do not block any of the inlet/outlets of fluid distributor 502 in this configuration, and thus second inlet/outlet 508B and third inlet/outlet 508C remain open (shown by broken "X's" 530O). In this configuration, the switching system 520 enables fluid to move within the fluid foot support system 400, 420, 440 at any time, depending on the local forces applied by a wearer's foot at any given time, because both the "first fluid path" and the "second fluid path" are open. This configuration may be used, for example, to equalize pressure in the fluid foot support system 400, 420, 440 and/or to allow more free transfer of fluid as needed under natural foot motion.

Figure 8D:
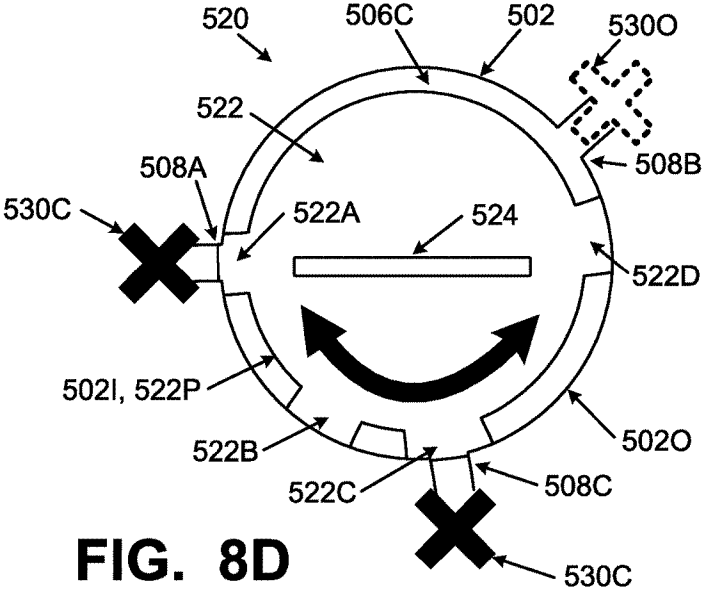

When the switching system 520 is further moved (e.g., rotated) to the position shown in FIG. 8D, raised surface 522A moves to seal the first inlet/outlet 508A of the fluid distributor 502 and raised surface 522C moves to seal the third inlet/outlet 508C (both shown by black "X's" 530C). The other raised surfaces 522B and 522D do not block any of the inlet/outlets of fluid distributor 502 in this configuration. Thus, second inlet/outlet 508B remains open (shown by broken "X" 530O) although it also could be closed off, if desired. In this configuration, both the first fluid path and the second fluid path described above in conjunction with FIGS. 5A and 5B are closed. This configuration may be used, for example, to substantially hold (e.g., substantially lock) a specific pressurized configuration in place (e.g., so the tilt orientation of plantar support surface PS remains stable and constant throughout a golf swing, so the plantar support structure PS remains stable while moving (walking, running, jumping, etc.), etc.).

Figure 9B:
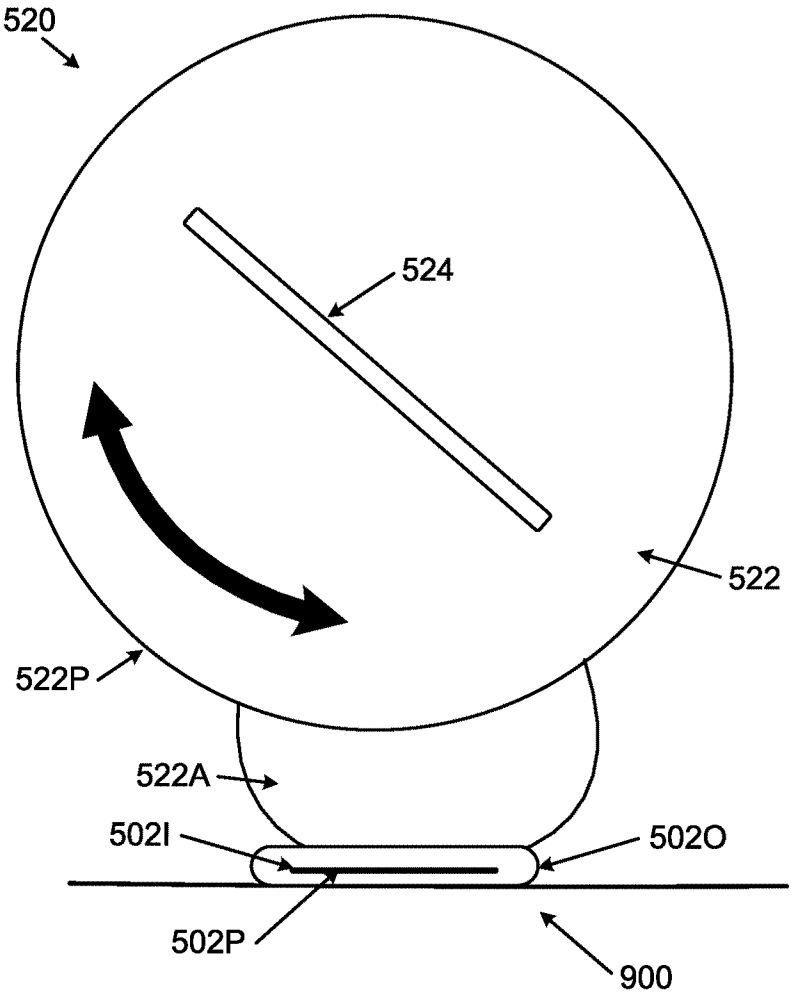
FIGS. 9A and 9B provide diagrams illustrating another example switching system for opening and closing a fluid path in accordance with some examples of this technology.
Figure 9A:
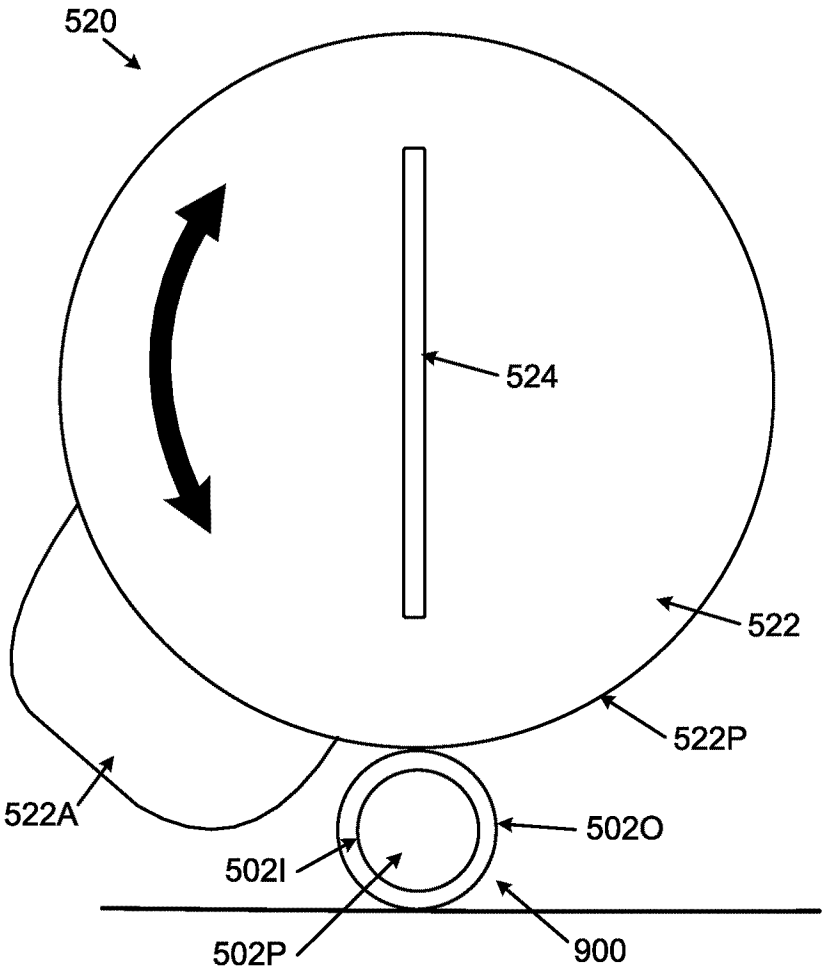

Other types of switching systems 520 and/or manners of selectively blocking fluid paths may be used without departing from this technology. For example, rather than placing any portion of the switch activator 522 within the interior chamber of fluid distributor 502, the switch activator 522 may be located outside the fluid distributor chamber 502 or other fluid path. FIGS. 9A and 9B illustrate an example. Where FIGS. 9A and/or 9B include reference numbers the same as those included in FIGS. 1A-8D, the same or similar parts are being referenced (including any disclosed characteristics, properties, variations, modifications, options and/or potential changes thereto), and some or all of the detailed repetitive description thereof may be omitted. The description below focuses on some structural differences between the switching system 520 of FIGS. 9A and 9B as compared to those described above.

As described above, various fluid paths used in aspects of this technology may be formed from the material of the fluid-filled bladder(s), and thus may have flexible walls. The example switching system 520 of FIGS. 9A and 9B take advantage of this fact and selectively close a fluid path by pinching a portion of the path closed and selectively open a fluid path by allowing the path to re-expand.

FIG. 9A illustrates a switch activator 522 located outside a fluid path 900, which may have a tubular construction with an outer wall 502O and an inner wall 502I and a fluid flow path 502P within it. The fluid path 900 may constitute part of the fluid distributor 502 and/or another part of the fluid flow control system 500, such as path portions 506A, 506B, 506C. An exterior surface 522P of switch activator 522 includes one or more raised surfaces (one raised surface 522A is shown in FIGS. 9A and 9B as an example). In the configuration of FIG. 9A, the raised surface 522A is positioned away from fluid path 900 and the fluid flow path 502P is open to fluid flow. When the switch activator 522 is moved (e.g., rotated), e.g., under manual or computer control, to the configuration of FIG. 9B, the raised surface 522A contacts the outer wall 502O of the fluid path 900 and pinches the fluid path 900 closed (e.g., so that opposite sides of the inner wall 502I contact one another and close fluid flow path 502P). Once the raised surface 522A again is moved away from fluid path 900, the fluid path 900 will reopen (e.g., to the configuration of FIG. 9A) and fluid can again flow within fluid path 900. More raised surfaces could be provided, e.g., in an arrangement like that shown in FIGS. 8A-8D and/or in an arrangement to selectively open and close path portions 506A, 506B, etc., to allow this external type of switch activator 522 to operate in the same general manner described above for FIGS. 8A to 8D.

The examples above focus on sideways tilt (e.g., downward tilt from the lateral side to the medial side) in a forefoot area of the sole structure 104 and/or article of footwear 100 under at least certain fluid flow configurations and/or conditions. Also, the above examples focus on sideways inward and downward tilt over at least some portion of the article of footwear 100 and/or sole structure 104 between: (a) the locations of the parallel planes defined for the forward ends 406F, 408F of bladders 400M, 400L, respectively and (b) the locations of the parallel planes defined for the rearward ends 406R, 408R of bladders 400M, 400L, respectively. The desired tilt is provided by movement of fluids to change the relative heights $H_M$, $H_L$ of the bladders 400M, 400L in different fluid flow configurations and/or conditions. Additionally or alternatively, if desired, the same or similar type of tilt could be provided in other areas of a sole structure 104 and/or article of footwear 100 as well, such as in one or more of: an arch or midfoot area, a heel area, an entire length of the sole structure 104 and/or article of footwear 100, etc. Tilt also could be provided in the other directions as well, such as in one or more of: downward in the medial side to lateral side direction, downward in the forefoot to heel direction, downward in the heel to forefoot direction, downward in a diagonal direction over at least a portion of the length, etc. The bladders 400M, 400L could be sized and shaped to provide a desired level of tilt in any desired direction for any desired type of activity or use.

III. Conclusion

The present invention is disclosed above and in the accompanying drawings with reference to a variety of example structures. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A foot support system, comprising:

a first side foot support bladder chamber;

a second side foot support bladder chamber;

a fluid flow control system including a first port and a second port, wherein the fluid flow control system moves fluid through each of a first fluid flow path and a second fluid flow path;

a first fluid line connecting the first port with the first side foot support bladder chamber; and a second fluid line connecting the second port with the second side foot support bladder chamber, wherein, in the first fluid flow path, fluid moves: (a) from the first side foot support bladder chamber, (b) through the first fluid line, (c) through the first port, (d) through the fluid flow control system to the second port, (e) through the second port, (f) through the second fluid line, and (g) into the second side foot support bladder chamber, wherein, in the second fluid flow path, fluid moves: (a) from the second side foot support bladder chamber, (b) through the second fluid line, (c) through the second port, (d) through the fluid flow control system to the first port, (e) through the first port, (f) through the first fluid line, and (g) into the first side foot support bladder chamber.

Clause 2. The foot support system according to Clause 1, wherein the fluid flow control system includes one or more fluid control devices including at least one of: (a) one or more valves and (b) one or more switches, wherein the one or more fluid control devices are configured to selectively and individually place the fluid flow control system in two or more of: (i) a first configuration in which the first fluid flow path is open while the second fluid flow path is closed, (ii) a second configuration in which the second fluid flow path is open while the first fluid flow path is closed, (iii) a third configuration in which both the first fluid flow path and the second fluid flow path are simultaneously open, and (iv) a fourth configuration in which both the first fluid flow path and the second fluid flow path are closed.

Clause 3. The foot support system according to Clause 1, wherein the fluid flow control system includes one or more fluid control devices including at least one of: (a) one or more valves and (b) one or more switches, wherein the one or more fluid control devices are configured to selectively and individually place the fluid flow control system in two or more of: (i) a first configuration in which the first fluid flow path is open while the second fluid flow path is closed, (ii) a second configuration in which the second fluid flow path is open while the first fluid flow path is closed, and (iii) a third configuration in which both the first fluid flow path and the second fluid flow path are simultaneously open.

Clause 4. The foot support system according to Clause 1, wherein the fluid flow control system includes one or more fluid control devices including at least one of: (a) one or more valves and (b) one or more switches, wherein the one or more fluid control devices are configured to selectively and individually place the fluid flow control system at least in: (i) a first configuration in which the first fluid flow path is open while the second fluid flow path is closed, and (ii) a second configuration in which the second fluid flow path is open while the first fluid flow path is closed.

Clause 5. The foot support system according to any one of Clauses 1 to 4, wherein the fluid flow control system includes:

a fluid distributor having a first inlet/outlet, a second inlet/outlet, and a third inlet/outlet, a first fluid distributor path joining the first port with the first inlet/outlet, a second fluid distributor path joining the first port with the third inlet/outlet, and a third fluid distributor path joining the second inlet/outlet with the third inlet/outlet.

Clause 6. The foot support system according to Clause 5, wherein the fluid distributor includes an outer wall through which each of the first inlet/outlet, the second inlet/outlet, and the third inlet/outlet extend.

Clause 7. The foot support system according to Clause 6, wherein the fluid distributor includes an inner wall contained within and spaced from the outer wall.

Clause 8. The foot support system according to Clause 6, wherein the fluid distributor has a toroidal shape.

Clause 9. The foot support system according to Clause 8, wherein the fluid distributor has a toroidal polyhedron shape.

Clause 10. The foot support system according to Clause 8, wherein the fluid distributor has a torus shape.

Clause 11. An article of footwear, comprising:

an upper;

a sole structure engaged with the upper; and the foot support system according to any one of Clauses 1 to 10 engaged with the upper and/or the sole structure.

Clause 12. The article of footwear according to Clause 11, wherein at least a portion of the fluid distributor is engaged with the upper.

Clause 13. A foot support system, comprising:

a first side foot support bladder chamber;

a second side foot support bladder chamber separated from the first side foot support bladder chamber;

a fluid distributor having a first inlet/outlet, a second inlet/outlet, and a third inlet/outlet;

a first fluid line connecting the first side foot support bladder chamber and the first inlet/outlet;

a second fluid line connecting the second side foot support bladder chamber and the second inlet/outlet;

a third fluid line connecting the third inlet/outlet to at least one of the first fluid line or the first side foot support bladder chamber; and a switch changing fluid flow directions through the foot support system into each of at least a first fluid flow path and a second fluid flow path, wherein:

(A) the first fluid flow path includes a first path extending: (a) from the first side foot support bladder chamber, (b) through the first fluid line, (c) through the first inlet/outlet, (d) through the fluid distributor to the second inlet/outlet, (e) through the second inlet/outlet, (f) through the second fluid line, and (g) into the second side foot support bladder chamber, (B) the second fluid flow path includes a second path extending: (a) from the second side foot support bladder chamber, (b) through the second fluid line, (c) through the second inlet/outlet, (d) through the fluid distributor to the third inlet/outlet, (e) through the third inlet/outlet, and (f) into the first side foot support bladder chamber through the first fluid line or another fluid path.

Clause 14. The foot support system according to Clause 13, wherein when the first fluid flow path is open, the switch closes as least some portion of the second fluid flow path.

Clause 15. The foot support system according to Clause 13 or 14, wherein when the second fluid flow path is open, the switch closes as least some portion of the first fluid flow path.

Clause 16. The foot support system according to any one of Clauses 13 to 15, wherein the switch further is movable to a position to simultaneously open both the first fluid flow path and the second fluid flow path.

Clause 17. The foot support system according to any one of Clauses 13 to 16, wherein the switch further is movable to simultaneously close both the first fluid flow path and the second fluid flow path.

Clause 18. The foot support system according to any one of Clauses 13 to 17, wherein the first fluid flow path further includes a first valve configured to permit fluid flow along the first path in a direction from the first side foot support bladder chamber toward the second side foot support bladder chamber but to prevent fluid flow along the first path in a direction from the second side foot support bladder chamber toward the first side foot support bladder chamber.

Clause 19. The foot support system according to any one of Clauses 13 to 18, wherein the second fluid flow path further includes a second valve configured to permit fluid flow along the second path in a direction from the second side foot support bladder chamber toward the first side foot support bladder chamber but to prevent fluid flow along the second path in a direction from the first side foot support bladder chamber toward the second side foot support bladder chamber.

Clause 20. The foot support system according to any one of Clauses 13 to 19, wherein the fluid distributor includes an outer wall through which each of the first inlet/outlet, the second inlet/outlet, and the third inlet/outlet extends.

Clause 21. The foot support system according to Clause 20, wherein the fluid distributor includes an inner wall contained within and spaced from the outer wall.

Clause 22. The foot support system according to Clause 21, wherein the switch includes a movable member that moves the inner wall with respect to the outer wall, the inner wall having at least a first stop element and a second stop element, wherein movement of the movable member to one or more discrete positions: (a) releasably closes the first inlet/outlet with the first stop element, and (b) releasably closes the third inlet/outlet with the second stop element.

Clause 23. The foot support system according to Clause 21, wherein the switch rotates the inner wall with respect to the outer wall, the inner wall having at least a first stop element and a second stop element, wherein rotation moves the inner wall with respect to the outer wall to one or more discrete positions to: (a) releasably close the first inlet/outlet with the first stop element, and (b) releasably close the third inlet/outlet with the second stop element.

Clause 24. The foot support system according to Clause 20, wherein the fluid distributor has a toroidal shape.

Clause 25. The foot support system according to Clause 24, wherein the fluid distributor has a toroidal polyhedron shape.

Clause 26. The foot support system according to Clause 24, wherein the fluid distributor has a torus shape.

Clause 27. The foot support system according to any one of Clauses 13 to 26, wherein the third fluid line connects the third inlet/outlet to the first fluid line.

Clause 28. The foot support system according to any one of Clauses 13 to 26, wherein the third fluid line connects the third inlet/outlet to the first side foot support bladder chamber.

Clause 29. The foot support system according to any one of Clauses 13 to 20 or 24 to 28, wherein the switch includes a movable member having at least a first stop element and a second stop element, wherein movement of the movable member to one or more discrete positions: (a) releasably closes the first inlet/outlet with the first stop element, and (b) releasably closes the third inlet/outlet with the second stop element.

Clause 30. The foot support system according to any one of Clauses 13 to 20 or 24 to 28, wherein the switch includes a rotatable member having at least a first stop element and a second stop element, wherein rotation of the rotatable member to one or more discrete positions: (a) releasably closes the first inlet/outlet with the first stop element, and (b) releasably closes the third inlet/outlet with the second stop element.

Clause 31. An article of footwear, comprising:

an upper;

a sole structure engaged with the upper; and the foot support system according to any one of Clauses 13 to 30 engaged with the upper and/or the sole structure.

Clause 32. The article of footwear according to Clause 31, wherein at least a portion of the fluid distributor is engaged with the upper.

Clause 33. A sole structure for an article of footwear, comprising:

a ground-facing member having an upper-facing surface and a ground-facing surface opposite the upper-facing surface; and a foot support according to any one of Clauses 1 to 10 or 13 to 30 at least partially covered by the ground-facing member.

Clause 34. The sole structure according to Clause 33, wherein the ground-facing member includes a polymeric foam midsole forming at least a portion of the upper-facing surface, and wherein the foot support is at least partially contained within a cavity defined in the upper-facing surface of the polymeric foam midsole.

Clause 35. The sole structure according to Clause 33, wherein the ground-facing member is an outsole, wherein the sole structure further comprises: a polymeric foam midsole engaged with the upper-facing surface of the ground-facing member, wherein the foot support is at least partially contained within the polymer foam midsole.

Clause 36. An article of footwear, comprising:

an upper; and a sole structure according to any one of Clauses 33 to 35 engaged with the upper.

Clause 37. A foot support system, comprising:

a first side foot support bladder chamber including a first inner side, a first outer side, a first top interior surface, and a first bottom interior surface;

a second side foot support bladder chamber including a second inner side, a second outer side, a second top interior surface, and a second bottom interior surface, wherein the second inner side faces the first inner side; and one or more fluid channels placing the first side foot support bladder chamber in fluid communication with the second side foot support bladder chamber to support movement of fluid between the first side foot support bladder chamber and the second side foot support bladder chamber, wherein the foot support system is configured to be changed between a first configuration and a second configuration by moving fluid between the first side foot support bladder chamber and the second side foot support bladder chamber through the one or more fluid channels, wherein:

(a) in the first configuration: (i) at a first location closer to the first outer side than to the first inner side, the first top interior surface and the first bottom interior surface are spaced from one another by a first height and (ii) at a second location closer to the second outer side than to the second inner side, the second top interior surface and the second bottom interior surface are spaced from one another by a second height, (b) in the second configuration: (i) at the first location, the first top interior surface and the first bottom interior surface are spaced from one another by a third height and (ii) at the second location, the second top interior surface and the second bottom interior surface are spaced from one another by a fourth height, (c) the first height is greater than the third height, and the fourth height is greater than the second height.

Clause 38. The foot support system according to Clause 37, further comprising: a plantar support surface supported by top surfaces of the first side foot support bladder chamber and the second side foot support bladder chamber, wherein, with the foot support system supported on a horizontal base surface: (a) in the first configuration, the plantar support surface extends at a first angle with respect to the horizontal base surface, (b) in the second configuration, the plantar support surface extends at a second angle with respect to the horizontal base surface, and (c) the second angle is at least 2 degrees greater than the first angle.

Clause 39. The foot support system according to Clause 37 or 38, further comprising: a first footwear component part, wherein the first side foot support bladder chamber and the second side foot support bladder chamber are engaged with the first footwear component part.

Clause 40. The foot support system according to Clause 39, wherein the first footwear component part includes a polymeric foam midsole.

Clause 41. The foot support system according to Clause 40, wherein the polymeric foam midsole includes a cavity in which the first side foot support bladder chamber and the second side foot support bladder chamber are located.

Clause 42. The foot support system according to any one of Clauses 39 to 41, wherein the first footwear component part forms at least a portion of an exterior sidewall surface of the foot support system, wherein the exterior sidewall surface includes at least one of: (a) a first expandable structure to permit height change between the first height and the third height, and/or (b) a second expandable structure to permit height change between the second height and the fourth height.

Clause 43. The foot support system according to Clause 42, wherein the first expandable structure includes a first opening defined through the exterior sidewall surface through which the first outer side is exposed, and/or wherein the second expandable structure includes a second opening defined through the exterior sidewall surface through which the second outer side is exposed.

Clause 44. The foot support system according to any one of Clauses 37 to 43, further comprising: a fluid flow control system engaged with the one or more fluid channels placing the first side foot support bladder chamber in fluid communication with the second side foot support bladder chamber, wherein the fluid flow control system selectively moves fluid between the first side foot support bladder chamber and the second side foot support bladder chamber through the one or more fluid channels to selectively place the foot support system independently in at least the first configuration and the second configuration.

Clause 45. The foot support system according to Clause 44, wherein the fluid flow control system selectively opens a first fluid path and a second fluid path through the one or more fluid channels, wherein: (a) opening the first fluid path and closing the second fluid path configures the one or more fluid channels to move fluid to change the foot support system from the first configuration to the second configuration, and (b) opening the second fluid path and closing the first fluid path configures the one or more fluid channels to move fluid to change the foot support system from the second configuration to the first configuration.

Clause 46. The foot support system according to Clause 45, wherein the fluid flow control system selectively configures the foot support system into a third configuration, wherein in the third configuration, both the first fluid path and the second fluid path are open.

Clause 47. The foot support system according to Clause 45 or 46, wherein the fluid flow control system selectively configures the foot support system into an additional configuration, wherein in the additional configuration, both the first fluid path and the second fluid path are closed.

Clause 48. A sole structure, comprising:

a sole component; and the foot support system according to any one of Clauses 37 to 47, wherein each of the first side foot support bladder chamber and the second side foot support bladder chamber is engaged with the sole component.

Clause 49. An article of footwear, comprising:

an upper;

a sole structure engaged with the upper; and the foot support system according to any one of Clauses 37 to 47 engaged with the upper and/or the sole structure.

Clause 50. The article of footwear according to Clause 49, wherein at least a portion of the one or more fluid channels is engaged with the upper.

What is claimed is:

1. A foot support system, comprising:

a medial side forefoot support bladder chamber filled with a gas;

a lateral side forefoot support bladder chamber filled with the gas;

a fluid flow control system including a first port and a second port, wherein the fluid flow control system moves the gas through each of a first fluid flow path and a second fluid flow path;

a first fluid line connecting the first port with the medial side forefoot support bladder chamber; and a second fluid line connecting the second port with the lateral side forefoot support bladder chamber, wherein, in the first fluid flow path, the gas moves: (a) from the medial side forefoot support bladder chamber, (b) through the first fluid line, (c) through the first port, (d) through the fluid flow control system to the second port, (e) through the second port, (f) through the second fluid line, and (g) into the lateral side forefoot support bladder chamber to place a forefoot portion of a plantar support surface of the foot support system in a first tilt configuration, wherein, in the second fluid flow path, the gas moves: (a) from the lateral side forefoot support bladder chamber, (b) through the second fluid line, (c) through the second port, (d) through the fluid flow control system to the first port, (e) through the first port, (f) through the first fluid line, and (g) into the medial side forefoot support bladder chamber to place the forefoot portion of the plantar support surface in a second tilt configuration, wherein the first tilt configuration is tilted inward and downward as compared to the second tilt configuration.

2. The foot support system according to claim 1, wherein the fluid flow control system includes one or more fluid control devices including at least one of: (a) one or more valves and (b) one or more switches, wherein the one or more fluid control devices are configured to selectively and individually place the fluid flow control system in two or more of: (i) a first configuration in which the first fluid flow path is open while the second fluid flow path is closed, (ii) a second configuration in which the second fluid flow path is open while the first fluid flow path is closed, (iii) a third configuration in which both the first fluid flow path and the second fluid flow path are simultaneously open, and (iv) a fourth configuration in which both the first fluid flow path and the second fluid flow path are closed.

3. The foot support system according to claim 1, wherein the fluid flow control system includes:

a fluid distributor having a first inlet/outlet, a second inlet/outlet, and a third inlet/outlet, a first fluid distributor path joining the first port with the first inlet/outlet, a second fluid distributor path joining the first port with the third inlet/outlet, and a third fluid distributor path joining the second inlet/outlet with the third inlet/outlet, wherein the fluid distributor includes an outer wall through which each of the first inlet/outlet, the second inlet/outlet, and the third inlet/outlet extend.

4. The foot support system according to claim 3, wherein the fluid distributor has a toroidal shape, a toroidal polyhedron shape, or a torus shape.

5. A foot support system, comprising:

a medial side forefoot support bladder chamber filled with a gas;

a lateral side forefoot support bladder chamber separated from the medial side forefoot support bladder chamber and filled with the gas;

a fluid distributor having a first inlet/outlet, a second inlet/outlet, and a third inlet/outlet;

a first fluid line connecting the medial side forefoot support bladder chamber and the first inlet/outlet;

a second fluid line connecting the lateral side forefoot support bladder chamber and the second inlet/outlet;

a third fluid line connecting the third inlet/outlet to at least one of the first fluid line or the medial side forefoot support bladder chamber; and a switch configured for selectively changing fluid flow directions through the foot support system into each of at least a first fluid flow path and a second fluid flow path, wherein:

(A) the first fluid flow path includes a first path extending: (a) from the medial side forefoot support bladder chamber, (b) through the first fluid line, (c) through the first inlet/outlet, (d) through the fluid distributor to the second inlet/outlet, (e) through the second inlet/outlet, (f) through the second fluid line, and (g) into the lateral side forefoot support bladder chamber, (B) the second fluid flow path includes a second path extending: (a) from the lateral side forefoot support bladder chamber, (b) through the second fluid line, (c) through the second inlet/outlet, (d) through the fluid distributor to the third inlet/outlet, (e) through the third inlet/outlet, and (f) into the medial side forefoot support bladder chamber through the first fluid line or another fluid path, wherein the gas moving through the first fluid flow path places a forefoot portion of a plantar support surface of the foot support system in a first tilt configuration, wherein the gas moving through the second fluid flow path places the forefoot portion of the plantar support surface in a second tilt configuration, and wherein the first tilt configuration is tilted inward and downward as compared to the second tilt configuration.

6. The foot support system according to claim 5, wherein the switch further is movable to a position to simultaneously open both the first fluid flow path and the second fluid flow path.

7. The foot support system according to claim 5, wherein the switch further is movable to simultaneously close both the first fluid flow path and the second fluid flow path.

8. The foot support system according to claim 5, wherein the first fluid flow path further includes a first valve configured to permit the gas to flow along the first path in a direction from the medial side forefoot support bladder chamber toward the lateral side forefoot support bladder chamber but to prevent the gas from flowing along the first path in a direction from the lateral side forefoot support bladder chamber toward the medial side forefoot support bladder chamber.

9. The foot support system according to claim 8, wherein the second fluid flow path further includes a second valve configured to permit the gas to flow along the second path in a direction from the lateral side forefoot support bladder chamber toward the medial side forefoot support bladder chamber but to prevent the gas from flowing along the second path in a direction from the medial side forefoot support bladder chamber toward the lateral side forefoot support bladder chamber.

10. The foot support system according to claim 9, wherein the fluid distributor includes an outer wall through which each of the first inlet/outlet, the second inlet/outlet, and the third inlet/outlet extends.

11. The foot support system according to claim 5, wherein the third fluid line connects the third inlet/outlet to the first fluid line.

12. A foot support system, comprising:

a medial side forefoot support bladder chamber filled with a gas and including a first inner side, a first outer side, a first top interior surface, and a first bottom interior surface;

a lateral side forefoot support bladder chamber filled with the gas and including a second inner side, a second outer side, a second top interior surface, and a second bottom interior surface, wherein the second inner side faces the first inner side;

a plantar support surface supported by top surfaces of the medial side forefoot support bladder chamber and the lateral side forefoot support bladder chamber; and one or more fluid channels placing the medial side forefoot support bladder chamber in fluid communication with the lateral side forefoot support bladder chamber to support movement of the gas between the medial side forefoot support bladder chamber and the lateral side forefoot support bladder chamber, wherein the foot support system is configured to be changed between a first configuration and a second configuration by moving the gas between the medial side forefoot support bladder chamber and the lateral side forefoot support bladder chamber through the one or more fluid channels, wherein:

(a) in the first configuration: (i) at a first location closer to the first outer side than to the first inner side, the first top interior surface and the first bottom interior surface are spaced from one another by a first height and (ii) at a second location closer to the second outer side than to the second inner side, the second top interior surface and the second bottom interior surface are spaced from one another by a second height, (b) in the second configuration: (i) at the first location, the first top interior surface and the first bottom interior surface are spaced from one another by a third height and (ii) at the second location, the second top interior surface and the second bottom interior surface are spaced from one another by a fourth height, (c) the first height is greater than the third height, and the fourth height is greater than the second height, wherein, in the second configuration, the plantar support surface of the foot support system is tilted inward and downward as compared to the first configuration.

13. The foot support system according to claim 12, wherein, with the foot support system supported on a horizontal base surface: (a) in the first configuration, the plantar support surface extends at a first angle with respect to the horizontal base surface, (b) in the second configuration, the plantar support surface extends at a second angle with respect to the horizontal base surface, and (c) the second angle is at least 2 degrees greater than the first angle.

14. The foot support system according to claim 12, further comprising:

a midsole component, wherein the medial side forefoot support bladder chamber and the lateral side forefoot support bladder chamber are engaged with the midsole component, wherein the midsole component includes a polymeric foam material, and wherein the midsole component includes a cavity in which the medial side forefoot support bladder chamber and the lateral side forefoot support bladder chamber are located.

15. The foot support system according to claim 14, wherein the midsole component forms at least a portion of an exterior sidewall surface of the foot support system, wherein the exterior sidewall surface includes at least one of: (a) a first expandable structure configured to change height when the foot support system changes between the first height and the third height at the first location, and/or (b) a second expandable structure configured to change height when the foot support system changes between the second height and the fourth height at the second location.

16. The foot support system according to claim 15, wherein the first expandable structure includes a first opening defined through the exterior sidewall surface formed by the midsole component, wherein the first outer side is exposed through the first opening, and/or wherein the second expandable structure includes a second opening defined through the exterior sidewall surface formed by the midsole component, and wherein the second outer side is exposed through the second opening.

17. The foot support system according to claim 12, further comprising:

a fluid flow control system engaged with the one or more fluid channels placing the medial side forefoot support bladder chamber in fluid communication with the lateral side forefoot support bladder chamber, wherein the fluid flow control system selectively moves the gas between the medial side forefoot support bladder chamber and the lateral side forefoot support bladder chamber through the one or more fluid channels to selectively place the foot support system independently in at least the first configuration and the second configuration, wherein the fluid flow control system selectively opens a first fluid path and a second fluid path through the one or more fluid channels, and wherein: (a) opening the first fluid path and closing the second fluid path configures the one or more fluid channels to move the gas to change the foot support system from the first configuration to the second configuration, and (b) opening the second fluid path and closing the first fluid path configures the one or more fluid channels to move the gas to change the foot support system from the second configuration to the first configuration.

18. The foot support system according to claim 17, wherein the fluid flow control system selectively configures the foot support system into a third configuration, wherein in the third configuration, both the first fluid path and the second fluid path are open.

19. The foot support system according to claim 1, further comprising:

a midsole component that includes a polymeric foam material, the midsole component including a cavity, wherein the medial side forefoot support bladder chamber and the lateral side forefoot support bladder chamber are located in the cavity, and wherein the midsole component forms at least a portion of an exterior sidewall surface of the foot support system, wherein the exterior sidewall surface includes at least one of: (a) a first expandable structure configured to change height when the forefoot portion of the plantar support surface changes between the first tilt configuration and the second tilt configuration, wherein the first expandable structure includes a first opening defined through the exterior sidewall surface formed by the midsole component, wherein an outer side of the medial side forefoot support bladder chamber is exposed through the first opening, and/or (b) a second expandable structure configured to change height when the forefoot portion of the plantar support surface changes between the first tilt configuration and the second tilt configuration, wherein the second expandable structure includes a second opening defined through the exterior sidewall surface formed by the midsole component, and wherein an outer side of the lateral side forefoot support bladder chamber is exposed through the second opening.

20. The foot support system according to claim 5, further comprising:

a midsole component that includes a polymeric foam material, the midsole component including a cavity, wherein the medial side forefoot support bladder chamber and the lateral side forefoot support bladder chamber are located in the cavity, and wherein the midsole component forms at least a portion of an exterior sidewall surface of the foot support system, wherein the exterior sidewall surface includes at least one of: (a) a first expandable structure configured to change height when the forefoot portion of the plantar support surface changes between the first tilt configuration and the second tilt configuration, wherein the first expandable structure includes a first opening defined through the exterior sidewall surface formed by the midsole component, wherein an outer side of the medial side forefoot support bladder chamber is exposed through the first opening, and/or (b) a second expandable structure configured to change height when the forefoot portion of the plantar support surface changes between the first tilt configuration and the second tilt configuration, wherein the second expandable structure includes a second opening defined through the exterior sidewall surface formed by the midsole component, and wherein an outer side of the lateral side forefoot support bladder chamber is exposed through the second opening.

* * * * *